US009004481B2

(12) United States Patent
Mimura et al.

(10) Patent No.: US 9,004,481 B2
(45) Date of Patent: Apr. 14, 2015

(54) SHEET STORING APPARATUS, POST-PROCESSING APPARATUS AND IMAGE FORMING SYSTEM HAVING THE SAME

(71) Applicants: Hideki Mimura, Yamanashi-ken (JP); Kenta Idezuki, Yamanashi-ken (JP); Kenichi Sano, Yamanashi-ken (JP)

(72) Inventors: Hideki Mimura, Yamanashi-ken (JP); Kenta Idezuki, Yamanashi-ken (JP); Kenichi Sano, Yamanashi-ken (JP)

(73) Assignees: Riso Kagaku Corporation, Tokyo (JP); Nisca Corporation, Minamikoma-gun, Yamanashi-ken (JP)

( * ) Notice: Subject to any disclaimer, the term of this patent is extended or adjusted under 35 U.S.C. 154(b) by 0 days.

(21) Appl. No.: 14/012,513

(22) Filed: Aug. 28, 2013

(65) Prior Publication Data

US 2014/0061994 A1 Mar. 6, 2014

(30) Foreign Application Priority Data

Aug. 31, 2012 (JP) ..... 2012-191419

(51) Int. Cl.

| | |
|---|---|
| ***B65H 39/00*** | (2006.01) |
| ***B65H 3/06*** | (2006.01) |
| ***B65H 31/00*** | (2006.01) |
| ***B65H 5/06*** | (2006.01) |
| ***B65H 29/14*** | (2006.01) |
| ***B65H 31/10*** | (2006.01) |
| ***B65H 31/26*** | (2006.01) |
| ***B65H 31/30*** | (2006.01) |
| ***B65H 31/34*** | (2006.01) |
| ***B65H 33/08*** | (2006.01) |
| ***B65H 39/10*** | (2006.01) |

(52) U.S. Cl.

CPC ..... *B65H 39/00* (2013.01); *B65H 3/06* (2013.01); *B65H 31/00* (2013.01); *B65H 5/068* (2013.01); *B65H 29/14* (2013.01); *B65H 31/10* (2013.01); *B65H 31/26* (2013.01); *B65H 31/3027* (2013.01); *B65H 31/34* (2013.01); *B65H 33/08* (2013.01); *B65H 39/10* (2013.01); *B65H 2301/4213* (2013.01); *B65H 2404/1321* (2013.01); *B65H 2404/1441* (2013.01); *B65H 2404/1521* (2013.01); *B65H 2404/166* (2013.01); *B65H 2404/693* (2013.01); *B65H 2511/152* (2013.01); *B65H 2511/20* (2013.01); *B65H 2511/415* (2013.01); *B65H 2511/51* (2013.01); *B65H 2801/27* (2013.01)

(58) Field of Classification Search

CPC ..... B31F 5/001; B65H 37/04; B65H 9/00; B65H 31/02; B65H 2801/27; B65H 5/062; B65H 5/068; B65H 29/12

USPC ..... 270/58.08, 58.11, 58.12, 58.17; 271/273, 274

See application file for complete search history.

(56) References Cited

U.S. PATENT DOCUMENTS

| | | | | |
|---|---|---|---|---|
| 4,034,976 | A * | 7/1977 | Lundblad | 271/10.09 |
| 6,427,997 | B1 * | 8/2002 | Hirota et al. | 270/58.12 |

(Continued)

FOREIGN PATENT DOCUMENTS

| | | | |
|---|---|---|---|
| JP | 4057233 | A | 3/2008 |
| JP | 2009-035371 | A | 2/2009 |

*Primary Examiner* — Leslie A Nicholson, III

(74) *Attorney, Agent, or Firm* — Manabu Kanesaka

(57) ABSTRACT

In a provided apparatus, an upper roller to be engaged with a sheet upper face and a lower roller to be engaged with a sheet lower face are arranged at a sheet discharging port in a manner capable of being pressure-contacted and being separated, the upper roller is formed with a large-diameter soft roll face and a small-diameter hard roll face, and a pressurization force of roller lifting-lowering means with which the upper roller is pressure-contacted to and is separated from the lower roller is switched to be high or low.

8 Claims, 22 Drawing Sheets

(56) References Cited

U.S. PATENT DOCUMENTS 6,726,196 B2 * 4/2004 Kirino ..... 270/58.11
6,909,873 B2 * 6/2005 Okubo ..... 399/406
8,104,759 B2 * 1/2012 Kawaguchi ..... 270/58.12
8,109,497 B2 * 2/2012 Okamoto et al. ..... 270/58.14
8,172,214 B2 * 5/2012 Kubota et al. ..... 270/58.1

* cited by examiner

| | Sensor 1 | Sensor 2 | Sensor 3 |
|---|---|---|---|
| (Ⅰ) Straight sheet discharging at appropriate tray height | ON | ON | |
| (Ⅱ) Straight sheet discharging at high tray height | OFF | ON | |
| (Ⅲ) Straight sheet discharging at low tray height | ON | OFF | |
| (Ⅳ) Sheet bundle discharging at appropriate tray height | ON | | ON |
| (Ⅴ) Sheet bundle discharging at high tray height | ON | | OFF |
| (Ⅵ) Sheet bundle discharging at low tray height | OFF | | ON |

SHEET STORING APPARATUS, POST-PROCESSING APPARATUS AND IMAGE FORMING SYSTEM HAVING THE SAME

BACKGROUND OF THE INVENTION

1. Field of the Invention

The present invention relates to a sheet storing apparatus which stores sheets fed from an image forming apparatus or the like at a downstream stack tray with or without performing a post-process thereon, and relates to improvement of a sheet discharging mechanism which conveys a sheet fed from a sheet discharging path toward the downstream stack tray.

2. Description of Related Arts

In general, in such a sheet storing apparatus, a pair of frictional rotors are arranged at a sheet discharging port and sheets are conveyed to the downstream side thereby. Belts, rollers, or the like have been adopted as the frictional rotors. For example, Japanese Patent Application Laid-Open No. 2009-035371 (Patent Document 1) discloses an apparatus in which a sheet fed to a sheet discharging path is conveyed by a pair of rollers arranged at a sheet discharging port selectively to a processing tray or a stack tray at the downstream side. The processing tray is provided with a post-processing mechanism such as stapling mechanism to perform staple-binding as collating and stacking sheets fed from the sheet discharging path and to discharge the bound sheet bundle to the stack tray.

The sheet discharging path is arranged so that sheet conveying to the processing tray and sheet conveying to the stack tray can be selectively performed. In the apparatus of Patent Document 1, a sheet at the sheet discharging port is fed to the stack tray when the pair of sheet discharging rollers arranged at the sheet discharging port are rotated in a forward direction and is fed to the processing tray when the rotation thereof is switched from the forward direction to the reverse direction.

In Patent Document 1, a reversing roller is connected to a drive motor as being rotatable in the forward and reverse directions and the pair of rollers are arranged as being switchable between an operation state of being mutually press-contacted and a waiting state of being separated. In the above structure, a roller (upper roller) to be engaged with an upper face of a sheet fed from the sheet discharging port is supported by a swingable arm member and the arm member is connected to an actuator such as a motor and a solenoid. A detection signal from a sheet sensor arranged at the discharging port causes the upper roller to be vertically moved from the waiting position being apart from the lower roller to the operation position being pressure-contacted thereto.

Further, Japanese Patent No. 4057233 (Patent Document 2) discloses a sheet discharging mechanism with discharges sheets by a pair of rollers through a sheet discharging port. Here, Patent Document 2 discloses the pair of rollers which are mutually pressure-contacted and a paddle member which is arranged around the pair of rollers. With the sheet discharging mechanism, a sheet is discharged through the sheet discharging port by the pair of rollers and a sheet tailing end being apart from the rollers is kicked by the paddle member to prevent the sheet tailing end from being jammed as being caught on a roller circumferential face after leaving from the rollers.

SUMMARY OF THE INVENTION

As described above, there has been widely known a post-processing apparatus having a conveyance mode in which a sheet fed to a discharging port is conveyed toward a stack tray and a conveyance mode in which a sheet is conveyed from the sheet discharging port to a processing tray with switch-back conveying. In such a post-processing apparatus, sheet conveyance conditions with a conveying rotor (a pair of sheet discharging rollers) arranged at the sheet discharging port vary in accordance with each conveyance mode. For example, when a sheet is to be fed to the stack tray through the sheet discharging port, the sheet is conveyed as being nipped by the pair of rollers. On the other hand, when a sheet is to be fed to the processing tray through the sheet discharging port, the sheet is reversely conveyed after being fed only by an upper roller through the sheet discharging port onto a stacked sheet by a predetermined amount.

As described above, conveyance operations are different between nipping conveyance performed when a sheet is conveyed to the stack tray by the pair of sheet discharging rollers arranged at the sheet discharging port and sliding conveyance performed when a sheet is conveyed to the processing tray. Here, following problems occur. Mutual friction causes image blurring on freshly-fixed sheets fed from an image forming apparatus or the like. Such image blurring frequently occurs when sheets are conveyed to the processing tray. That is, a plurality of sheets are stacked on the lower roller which is contacted thereto in a stopped state. The upper roller connected to a drive motor conveys a sheet introduced through the sheet discharging port onto the upmost sheet in the sheet discharging direction as being engaged therewith, and then, conveys the sheet in an opposite direction to the sheet conveying direction. If fixing of an image on the sheet is insufficient, high contact pressure between the sheet and the rollers causes image blurring. In addition, there arises a problem that a subsequent sheet gets dirty with ink adherent to the rollers.

On the other hand, when a sheet is conveyed through the sheet discharging port directly to the stack tray, the sheet is discharged as being nipped between the lower roller and the upper roller while the lower roller is driven with driving rotation of the upper roller. During such conveyance, it is required for preventing image blurring and reliably storing a discharged sheet that discharging is performed in accordance with a circumferential speed of the rollers without frictional sliding between the upper roller and a sheet upper face and between the lower roller and a sheet lower face.

Conventionally, rollers having the same structure (material, outer diameter) are combined as a pair of sheet discharging rollers having at least two conveyance modes. Here, conventionally, the sheet discharging mechanism having a mode in which a sheet is discharged through the sheet discharging port to the stack tray and a mode in which sheets are conveyed to the processing tray for being collated and stacked has the same structure for performing the operation in either mode.

Here, when sheets fed from the image forming apparatus are conveyed with a high roller pressurization force under conditions with mutual frictional sliding between the sheets, there arise problems of image ink blurring and noticeable dirt occurrence. When image forming is performed at the upstream image forming portion at high speed, ink friction and dirt develop into larger problems. Further, when a sheet is conveyed to the stack tray with a low roller pressurization force, there arises a problem of incomplete storing with incomplete discharging onto the stack tray or sheet jamming.

Then, the present inventors have come up with an idea that the configuration of the sheet discharging rollers is differentiated between a conveyance mode in which a sheet is discharged onto the stacked sheet through the sheet discharging port and a conveyance mode in which a sheet is swiftly discharged downstream.

The present invention provides a sheet storing apparatus which is capable of reliably conveying a sheet in either sheet discharge mode of a case to discharge a sheet through the sheet discharging port onto a sheet stacked on the processing tray and a case to discharge a sheet to the stack tray, without causing problems such as ink friction of image-formed sheet and dirt.

To address the above issues, in the present invention, an upper roller to be engaged with a sheet upper face and a lower roller to be engaged with a sheet lower face are arranged at a sheet discharging port in a manner capable of being pressure-contacted and being separated, the upper roller is formed with a large-diameter soft roll face and a small-diameter hard roll face, and a pressurization force of roller lifting-lowering means with which the upper roller is pressure-contacted to and is separated from the lower roller is switched to be high or low.

With the above configuration, when a sheet is discharged through the sheet discharging port to the stack tray one by one by the pair of sheet discharging rollers, the sheet is conveyed by the small-outer-diameter hard roll face with a high pressurization force while being pressure-contacted. Accordingly, the sheet can be reliably discharged onto the tray without causing ink friction of image on the sheet. Alternatively, when a sheet is collated and stacked on the processing tray through the sheet discharging port, the sheet is conveyed by the large-outer-diameter soft roll face with a low pressurization force while being pressure-contacted. Accordingly, the sheet can be stacked on the processing tray without causing ink friction and ink dirt.

A sheet storing apparatus of the present invention includes a sheet discharging path (11) on which a sheet is discharged through a sheet discharging port (13), a processing tray (15) which is arranged downstream of the sheet discharging port and on which a sheet is stored with a conveying direction reversed from the sheet discharging port, a stack tray (40) which is arranged downstream of the processing tray, a pair of sheet discharging rollers (20) which are arranged at the sheet discharging port and which convey a sheet fed from the sheet discharging path selectively to the processing tray or the stack tray, roller lifting-lowering means (a lifting-lowering lever 30 and a lifting-lowering motor SM) which shifts the pair of sheet discharging rollers between an operation state of being mutually pressure-contacted and a waiting state of being separated, and roller control means (a later-mentioned control means 85) which controls driving rotation of the pair of sheet discharging rollers and the roller lifting-lowering means.

Here, the pair of discharging rollers includes an upper roller (21) which is engaged with an upper face of a sheet fed through the sheet discharging path and a lower roller (22) which is engaged with a lower face of the sheet. The upper roller is formed with a soft roll face (21*a*) having a large outer circumferential diameter and a hard roll face (21*b*) having a small outer circumferential diameter. The roller lifting-lowering means is configured to be capable of adjusting a pressurization force to provide a low pressurization state in which only the soft roll face is contacted to the lower roller and a high pressurization state in which both of the soft roll face and the hard roll face are contacted to the lower roller. Further, the roller control means causes a conveyance force to be applied to the sheet fed through the sheet discharging port between the lower roller and the soft roll face or between the lower roller and both the soft roll face and the hard roll face in a selectable manner. With the above configuration, the soft roll face and the hard roll face are used differently in a case to convey sheets to the processing tray and other cases. In a case of conveying to the processing tray, the hard roll face is used while performing reliable conveyance in a high pressurization state. Accordingly, rumpling due to expansion of contact area with deformation of the roll face by pressurization is prevented from occurring. In a low pressurization state, owing to increasing contact area by using the soft roll face, reliable conveyance can be performed while preventing friction between sheets.

The lower roller is arranged at a sheet placement face (16) of the processing tray and the upper roller is arranged at an arm member (a later-mentioned roller bracket 24) which is swingably supported by an apparatus frame. Further, the arm member is equipped with a lifting-lowering motor (SM) which lifts and lowers the upper roller to an operating position (Ap) to be engaged with the lower roller and a waiting position (Wp) to be separated from the lower roller. Thus, owing to swinging of the upper roller and arrangement of the lower roller at the sheet placement face of the processing tray, sheets stacked on the processing tray is not vertically fluctuated and alignment thereof is not disturbed.

The control means (85) sets a pressurization force to be in a high pressurization state in which the hard roll face (21*b*) is contacted to a face of the lower roller when a sheet is discharged through the sheet discharging port to the stack tray and sets a pressurization force to be in a low pressurization state in which only the soft roll face (21*a*) is contacted to the face of the lower roller when a sheet is discharged through the sheet discharging port to the processing tray. Thus, in conveyance to the stack tray causing no frictional sliding between sheets, reliable conveyance is performed in the high pressurization state. In conveyance to the processing tray causing frictional sliding between sheets, dirt due to sheet friction is decreased by performing conveyance in the low pressurization state.

The control means provides a high pressurization state in which the hard roll face is engaged with a face of the lower roller when a sheet being the first is discharged onto the processing tray and provides a low pressurization state in which only the soft roll face is engaged with the face of the lower roller when a sheet being the second or later is discharged onto the processing tray. Thus, with a discharging operation causing no frictional sliding between sheets, reliable conveyance is performed in the high pressurization state. With a discharging operation having a possibility of frictional sliding between sheets, dirt due to sheet friction is decreased by performing conveyance in the low pressurization state.

A leading end regulating stopper (18) which aligns sheet leading ends and staple-binding means (17) are arranged at the processing tray (15), and the control means provides a high pressurization state in which the hard roll face is engaged with a face of the lower roller when a staple-bound sheet bundle is discharged by the pair of sheet discharging rollers (20) from the processing tray to the stack tray. Thus, in a case of discharging a staple-bound sheet bundle causing no frictional sliding between sheets, a reliable discharging operation can be performed in the high pressurization state.

The arm member swingably supports the upper roller (21) so that a pressure-contact point between the soft roll face and a face of the lower roller in the low pressurization state is located at a position being downstream of that in the high pressurization state in a sheet discharging direction when the upper roller is pressure-contacted to the lower roller (22). Thus, when a sheet is discharged to the stack tray in the high pressurization state, a sheet leading end in the discharging direction is floated. When a sheet is discharged to the processing tray in the low pressurization state, a sheet leading end in the discharging direction can be floated as well. Accordingly, a conveyance load can be reduced.

A face of the hard roll face is formed by performing hardening treatment such as teflon coating, ceramic coating, and fluorine coating on a face of a resin roll. Accordingly, dirt due to a sheet print face is prevented from occurring even with conveyance in the high pressurization state.

In the present invention, the upper roller of the pair of sheet discharging rollers arranged at the sheet discharging port in a manner capable of being pressure-contacted and separated is formed with the large-outer-diameter soft roll face and the small-outer-diameter hard roll face. Here, when a sheet is nipped and discharged one by one through the sheet discharging port, the sheet is conveyed by the small-outer-diameter hard roll face with a high pressurization force. When a sheet is discharged onto a stacked sheet through the sheet discharging port, the sheet is conveyed by the large-outer-diameter soft roll face with a low pressurization force. According to the above, following effects are obtained.

For example, when an image-formed sheet is discharged onto a stacked sheet through the sheet discharging port, the sheet discharging is performed by the conveying rollers at the sheet discharging port using the large-outer-diameter soft roll face with a low pressurization force. Accordingly, ink friction can be prevented from occurring owing to low engagement force between an introduced sheet and the upmost stacked sheet. Further, since the sheet face and roll face are pressure-contacted with a low pressurization force, a subsequent sheet is prevented from getting dirty with adhering of sheet ink onto the roll face.

Alternatively, when a sheet is stored at the stack tray at the downstream side as being nipped by the upper-lower pair of sheet discharging rollers, the sheet conveying is performed by the rollers using the small-outer-diameter hard roll face with a high pressurization force. Accordingly, the sheet can be reliably discharged to an accurate position on the tray.

Further, in the present invention, for performing surface coating on the pair of sheet discharging rollers in accordance with characteristics of ink in the image forming portion, the coating is performed on a face of the small-outer-diameter roller. Accordingly, a roll structure having sufficient durability without causing roller dirt such as ink adhering is obtained. Here, the large-outer-diameter roller is structured as a replaceable maintenance part being a soft roller using sponge or the like.

BRIEF DESCRIPTION OF THE DRAWINGS

FIGS. 5A to 5C are explanatory views illustrating operation states of the reversing roller mechanism; while FIG. 5A illustrates a waiting state in which an upper roller left from a lower roller, FIG. 5B illustrates a state in which the upper roller is engaged with the lower roller with a low pressurization force, and FIG. 5C illustrates a state in which the upper roller is engaged with the lower roller with a high pressurization force;

FIGS. 6A and 6B are explanatory views illustrating engagement states between the upper roller and the lower roller in FIGS. 5A and 5B; while FIG. 6A illustrates pressure-contacted faces of the rollers where the upper roller and the lower roller are engaged with a low pressurization force and FIG. 6B illustrates pressure-contacted faces of the rollers engaged with a high pressurization force;

FIGS. 13A to 13C are explanatory views illustrating operation states of the sheet holding unit; while FIG. 13A illustrates a waiting state of the sheet holding unit, FIG. 13B illustrates a state (low pressurization state) in which the sheet holding unit performs punching on a tailing end of a sheet bundle on the tray, and FIG. 13C illustrates a state (high pressurization state) in which the sheet holding unit presses the upmost sheet on the tray;

FIGS. 16A and 16B illustrate operation states of the tailing end supporting member; while FIG. 16A illustrates a state in which the support member enters a sheet placement tray and FIG. 16B illustrates a state in which the support member entered the tray supports a sheet bundle;

FIGS. 18A to 18D are explanatory views illustrating relations between a sheet bundle to be stored on the tray and the tailing end supporting member; while FIG. 18A illustrates a state in which the support member enters the tray, FIG. 18B illustrates a state in which a tailing end of the dropping bundle sheet is supported by the supporting member, FIG. 18C illustrates an initial state in which the tailing end supporting member is about to retract from the tray, and FIG. 18D illustrates a state in which the tailing end supporting member retracts from the tray;

FIGS. 20A and 20B are explanatory views of a sheet discharge mode in which a sheet fed to a sheet discharging path is stored at the stack tray one by one; while FIG. 20A is an explanatory view of an operation flow of jog discharging to collate and sort sheets on the stack tray and FIG. 20B is an explanatory view of operation flow when a sheet bundle is removed in a jog discharging mode;

DETAILED DESCRIPTION OF THE PREFERRED EMBODIMENT

Figure 1:
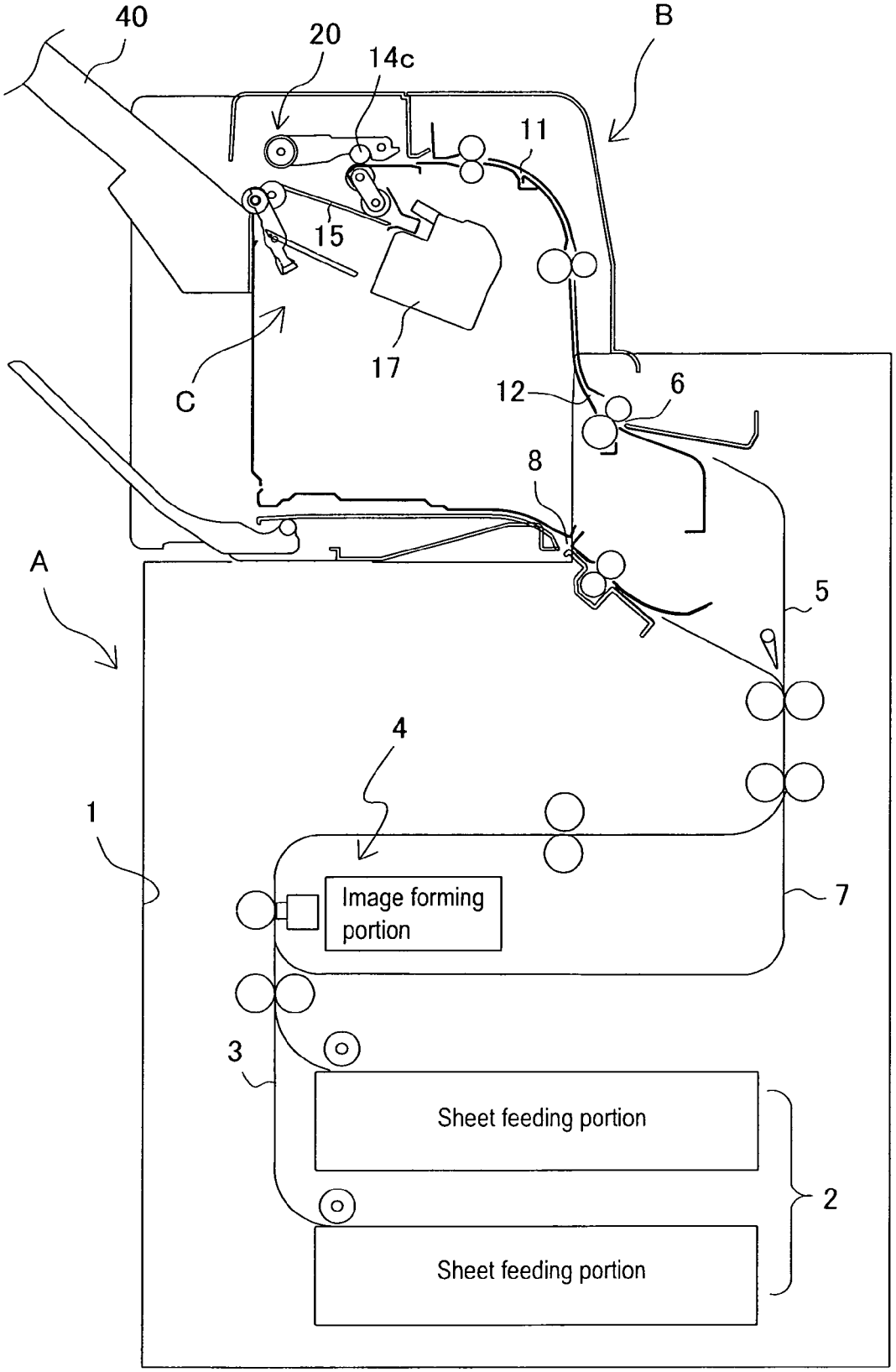
FIG. 1 is an explanatory view of a whole configuration of an image forming system according to the present invention.

In the following, the present invention will be described in detail based on preferred embodiments illustrated in the drawings. FIG. 1 illustrates an image forming system. The image forming system includes an image forming apparatus (unit) A which forms an image on a sheet and a post-processing apparatus (unit) B which performs a post-process such as a binding process of collating and stacking sheets with images formed thereon. A sheet storing apparatus (unit) C according to the present invention is built into the post-processing apparatus B. In the following, description will be performed on the image forming apparatus and the post-processing apparatus in the order thereof.

[Image Forming Apparatus]

The image forming apparatus A illustrated in FIG. 1 is connected to an image managing device such as a computer and a network scanner (not illustrated). The image forming apparatus A forms an image on a specified sheet based on image data transferred from such a device and discharges the sheet through a predetermined discharge port (later-mentioned sheet discharging port). Other than constituting such a network configuration, the image forming apparatus A is structured as a copying machine or a facsimile machine and copies and forms an image on a sheet based on image date read by a document scanning unit.

In the image forming apparatus A, a plurality of sheet feeding cassettes 2 are arranged at a housing 1. A sheet of a selected size is fed from the corresponding cassette to a sheet feeding path 3 located at the downstream side. An image forming mechanism (image forming portion) 4 is arranged at the sheet feeding path 3. A variety of types such as an ink-jet printing mechanism, an electrostatic printing mechanism, an offset printing mechanism, a silk-screen printing mechanism, and a ribbon-transfer printing mechanism have been known as the image forming mechanism 4. The present invention may be applied to any of the above printing mechanism.

A sheet discharging path 5 is arranged at the downstream side of the image forming mechanism 4. A sheet is discharged through a sheet discharging port 6 (hereinafter, called a body sheet discharging port) which is arranged at the housing 1. Here, in some printing mechanisms, a fixing unit (not illustrated) is built into the sheet discharging path 5. Thus, a sheet of a selected size is fed from the sheet feeding cassette 2 to the image forming portion 4, and then, is discharged through the body sheet discharging port 6 from the sheet discharging path 5 after an image is formed thereon. Further, a duplex path 7 is arranged in the housing 1. According to the duplex path 7, a sheet is face-reversed in the apparatus and is fed again to the image forming portion 4 after an image is formed on a front face of the sheet at the image forming portion 4. The sheet is discharged through the body discharging port 6 after an image is formed on a back face thereof. In the illustrated apparatus, a sheet is once fed-out to the outside of the housing through a discharge port 8 (see FIG. 1) which is different from the body sheet discharging port 6, and then, is fed again to the image forming portion 4 after being face-reversed at a U-turn path.

The post-processing apparatus B which will be described later is connected to the body sheet discharging port 6. There is also known a configuration in which a scanner unit and a document feeding unit which feeds a document sheet to the scanner unit are integrally assembled to the housing 1. The scanner unit in the above case performs scanning to read an image of a document sheet which is placed on a platen or fed from a feeder mechanism, and then, transfers the read data to an image forming unit. Further, the document feeding unit includes the feeder mechanism which feeds a document sheet onto the platen of the scanner unit. The present invention may be applied to a configuration which integrally includes such units.

[Post-Processing Apparatus]

The post-processing apparatus B illustrated in FIG. 2 includes a housing 10, a sheet conveying path (hereinafter, also called a sheet discharging path) 11 which is built into the housing 10, a processing tray 15, and a stack tray 40. Configurations of the above will be described in the following.

[Sheet Conveying Path]

The sheet conveying path 11 includes an introducing port 12 which is connected to the body discharging port 6 of the abovementioned image forming apparatus A, and a sheet discharging port 13. Here, a sheet with an image formed thereon is introduced from the introducing port 12 and is discharged through the sheet discharging port 13. The sheet conveying path 11 is configured as a sheet discharging path which transfers a sheet fed from the body discharging port 6 toward the later-mentioned stack tray 40. An introduction sensor Se1 to detect a sheet leading end is arranged at the introducing port 12 and a discharge sensor Se2 to detect a sheet tailing end is arranged at the sheet discharging port 13. Conveying rollers 14*a*, 14*b* to convey a sheet are arranged on the sheet conveying path 11 at an appropriate interval. Each of the conveying rollers 14*a*, 14*b* is connected with a roller drive motor (not illustrated). As illustrated in FIG. 2, the sheet conveying path 11 includes an approximately linear path as laterally extending in the housing 10 approximately in the horizontal direction. The processing tray 15 and the stack tray 40 are arranged as described below at the downstream side of the sheet discharging port 13 of the sheet conveying path 11.

[Processing Tray]

Figure 2:
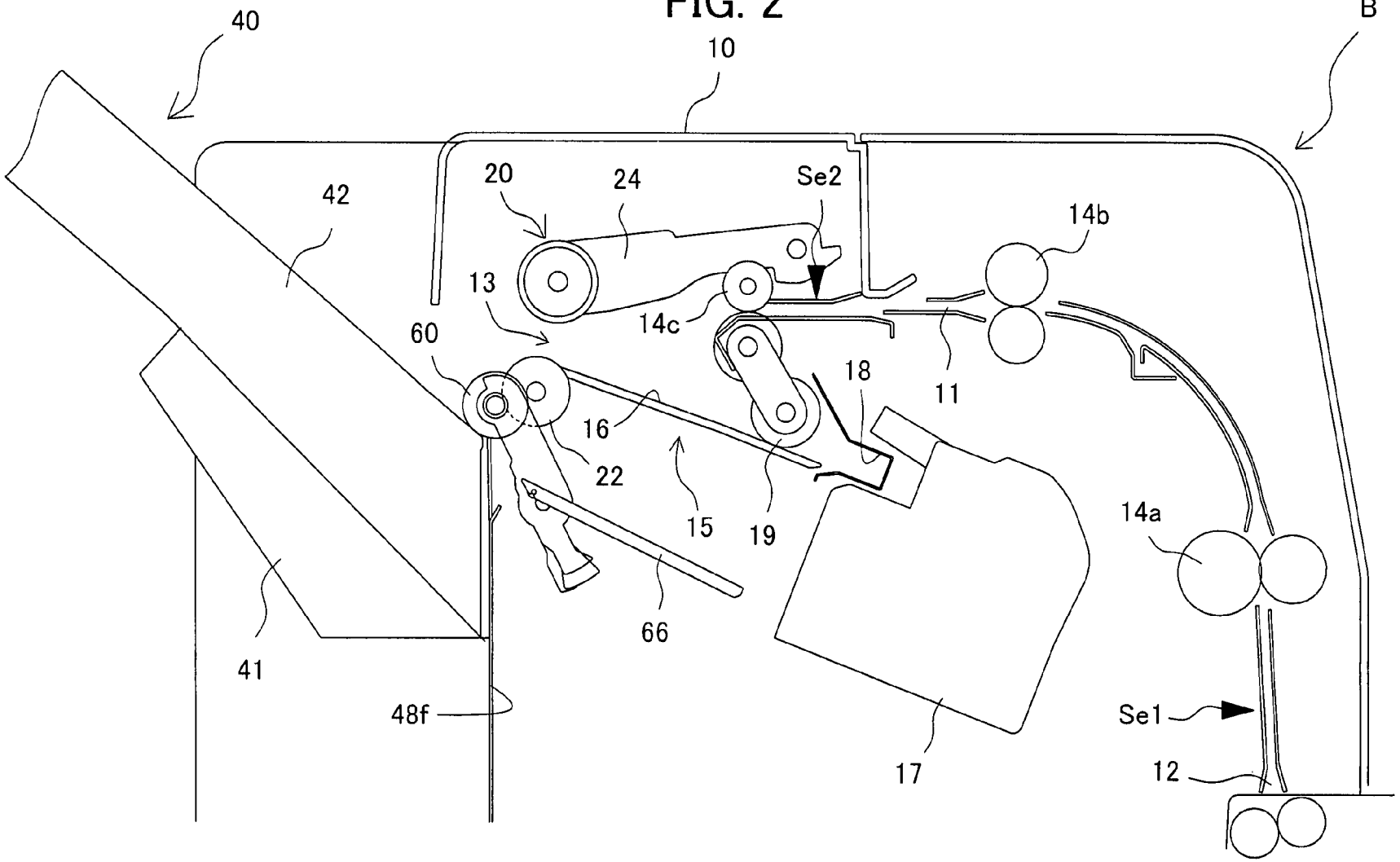
FIG. 2 is a structural explanatory view of a post-processing apparatus of the image forming system in FIG. 1.

As illustrated in FIG. 2, the processing tray 15 is provided with a sheet placement base 16 on which sheets are placed and supported at the downstream side of the sheet discharge port 13 as forming a step therefrom, aligning means (not illustrated) for the sheets placed on the sheet placement base 16, and post-processing means 17. The sheet placement base 16 in FIG. 2 is shaped to support a rear part of the sheet which is reversely conveyed (fed in a reverse direction from the sheet discharging direction) from the sheet discharging port 13. Then, the sheet is to be supported (bridge-supported) as a leading end part thereof being supported onto the later-mentioned stack tray 40 and a tailing end part thereof being supported by the sheet placement base 16. Thus, the stack tray 40 and the processing tray 15 are arranged approximately on the same plane and the sheet is supported at the front half part thereof by one tray and the rear half part thereof by the other tray. Accordingly, the apparatus can be downsized compared to a case that a plurality of trays to support the whole sheet respectively are arranged in the front-rear direction.

Further, a tailing end regulating stopper 18 which performs regulation with abutting against a sheet tailing end and an aligning mechanism (not illustrated) which biases and aligns sheets in a direction perpendicular to the sheet discharging direction are arranged at the sheet placement base 16. Since a variety of mechanisms have been known as such an aligning mechanism, detailed description thereof is skipped. Sheets introduced onto the processing tray 15 are positioned according to preset reference (center reference or side reference). The apparatus in FIG. 2 adopts the center reference.

A staple unit which performs a binding process of a collated and stacked sheet bundle is arranged at the sheet placement base 16 as the post-processing means 17. Such a staple unit has been known as a device which bends a linear staple needle into a U-shape, inserts the staple needle to a sheet bundle from an upper face to a lower face as bending leading ends of the staple needle. Thus, the post-processing means 17 adopts a staple unit, a punch unit, a stamp unit, a trimmer unit, or the like in accordance with apparatus specifications.

A reversing roller mechanism 20 is arranged at the sheet discharging port 13 of the sheet conveying path 11. The reversing roller mechanism 20 conveys a sheet fed to the sheet discharging port 13 to the downstream side in the sheet discharging direction and reverses the conveying direction at the time when the sheet trailing end passes through the sheet discharging port 13. Accordingly, the sheet is guided to the tailing end regulating stopper 18 from the tailing end side in the sheet discharging direction along the sheet placement base 16 of the processing tray 15.

A friction rotor 19 which guides the sheet to the tailing end regulating stopper 18 in cooperation with the reversing roller mechanism 20 arranged at the sheet discharging port 13 is arranged at the processing tray 15. In FIG. 2, the friction rotor 19 is placed at a position to be engaged with a stacked sheet on the sheet placement base 16. The friction rotor 19 is structured with a raking roller (or belt) and is driven by a drive belt to be rotated integrally with a sheet discharging roller 14*c*. Then, the friction rotor 19 is engaged with a stacked sheet owing to own weight. The sheet reversely conveyed from the reversing roller 20 with rotation of the friction rotor 19 being the raking roller is conveyed to the tailing end regulating stopper 18 and is stopped as being abutted thereto.

[Reversing Roller Mechanism]

Figure 3:
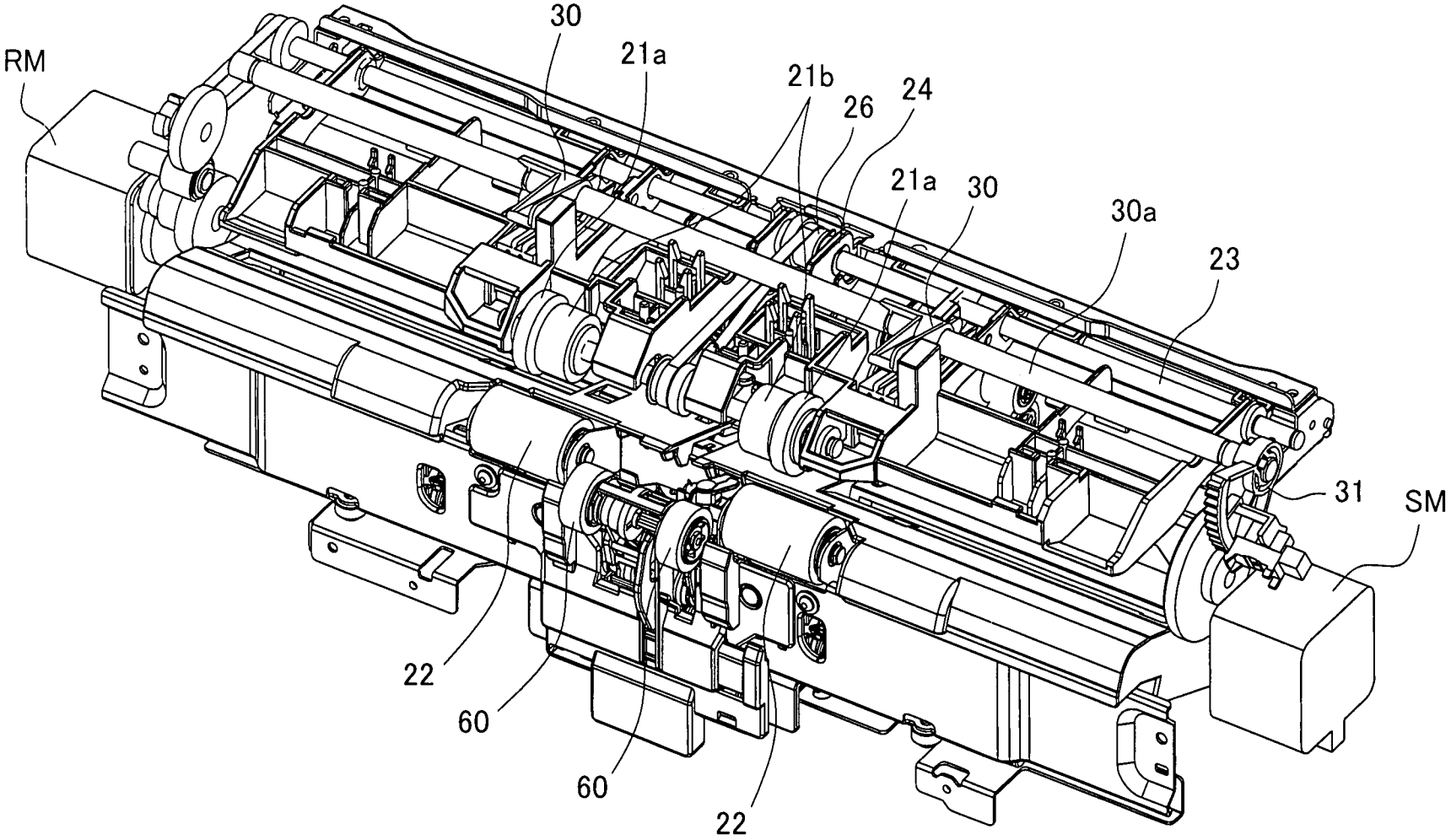
FIG. 3 is a perspective structural explanatory view of a sheet discharging mechanism of the post-processing apparatus in FIG. 2.
Figure 4A:
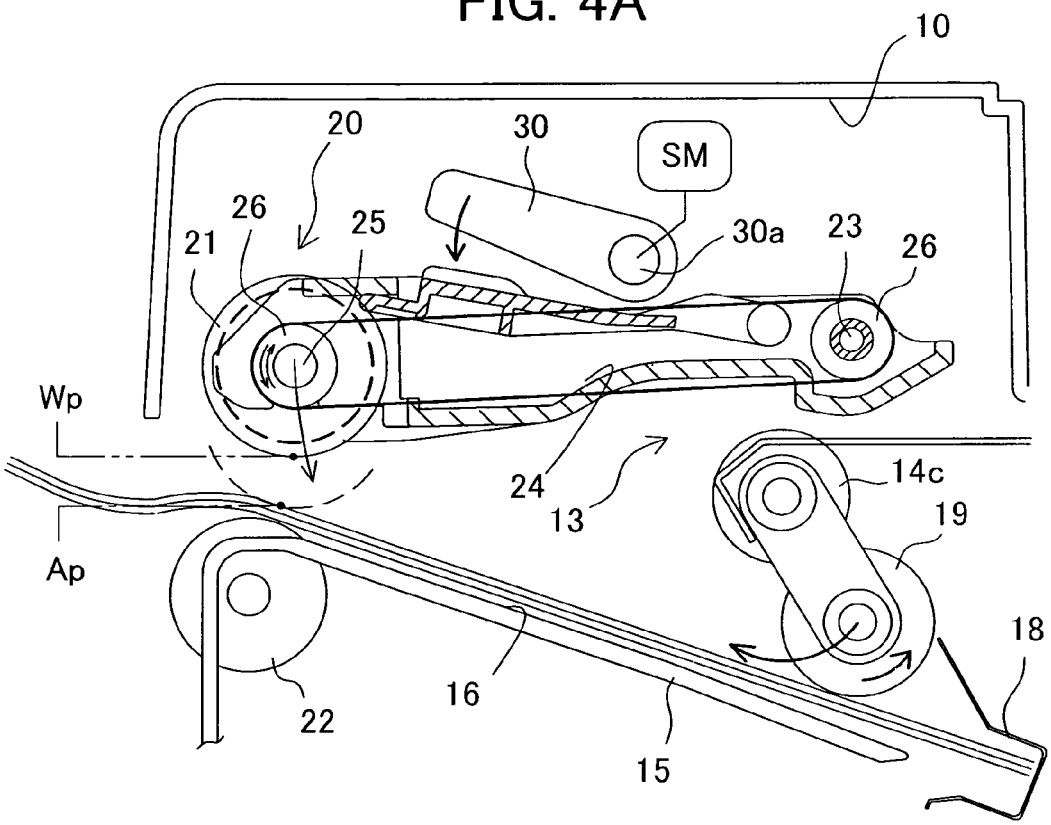
FIG. 4A is an explanatory view of a whole structure of a reversing roller mechanism of the post-processing apparatus in FIG. 2
Figure 4B:
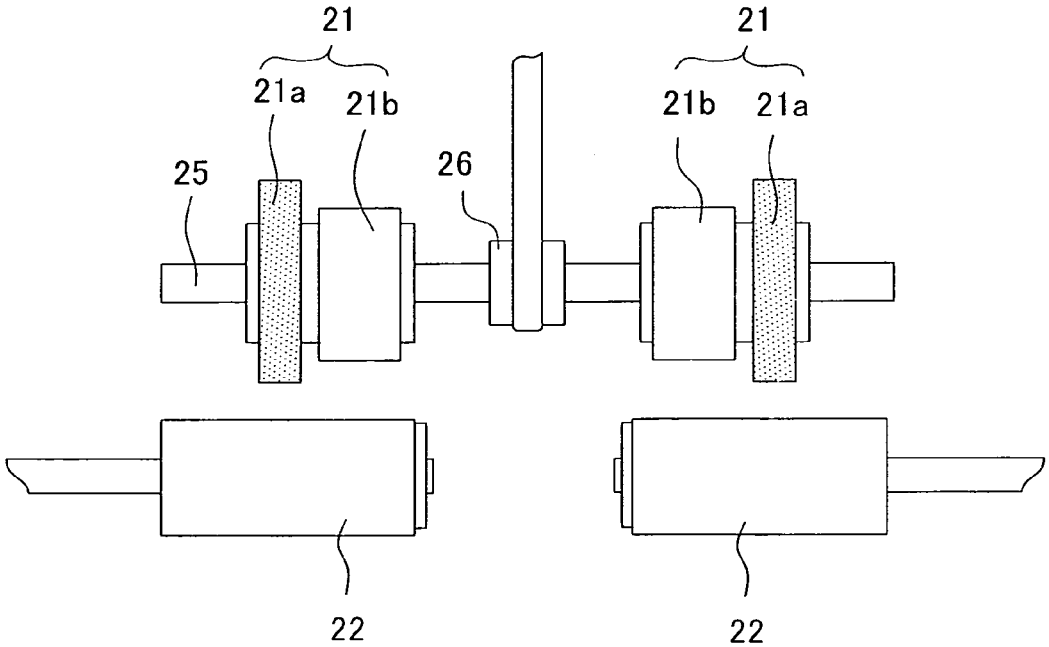
FIG. 4B is an explanatory view illustrating a shape of a reversing roller.

FIG. 3 is an explanatory perspective view illustrating a sheet discharging mechanism of the post-processing apparatus B. A pair of reversing rollers 20 are arranged at the center in the width direction of a sheet conveyed from the sheet discharging port 13. The reversing roller 20 transfers the sheet fed from the sheet discharge port 13 in the sheet discharging direction, and then, introduces the sheet to the processing tray 15 as reversing the conveying direction. FIGS. 4A and 4B specifically illustrate the reversing roller mechanism 20. FIG. 4A illustrates a lifting-lowering mechanism of the reversing roller 20. FIG. 4B illustrates a roller structure of an upper roller 21 and a lower roller 22. The reversing roller mechanism 20 is structured with the upper roller 21 which is engaged with an upper face of the sheet fed from the sheet discharging port 13 and the lower roller 22 which is engaged with a lower face of the sheet. The upper roller 21 is swingably supported by an apparatus frame F as being capable of being lifted and lowered between an operating position Ap to be pressure-contacted to the lower roller 22 and a waiting position Wp to be apart therefrom. Further, rotation of a roller drive motor (forward-reverse motor) RM is transmitted to the upper roller 21 to enable the upper roller 21 to rotate in the sheet discharging direction (clockwise direction in FIG. 4A) and an opposite direction to the sheet discharging direction (counterclockwise direction in FIG. 4A).

A right-left pair of roller brackets (swing arms) 24 is supported by the apparatus frame F as being swingable about a swing pivot 23. A roller rotary shaft 25 is rotatably bearing-supported by the pair of roller brackets 24. The upper roller 21 is fitted to the rotary shaft 25. The swing pivot 23 is supported by the apparatus frame F rotatably or fixedly. The roller bracket 24 is fitted to the swing pivot 23 directly or via a collar member. According to the above, a bracket base end portion is supported about the swing pivot 23 swingably to a direction of an arbitral angle. Further, a collar member (rotary collar) is loosely fitted to the swing pivot 23 and a drive pulley 26 which transmits rotation to the rotary shaft 25 of the upper roller 21 is connected to the collar member. The roller drive motor RM is connected to the drive pulley 26.

Figure 5A:
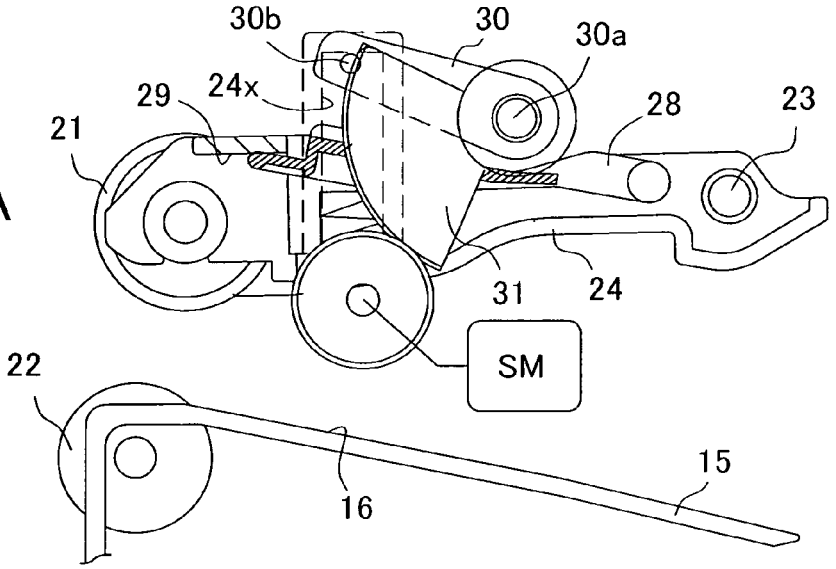
Figure 5B:
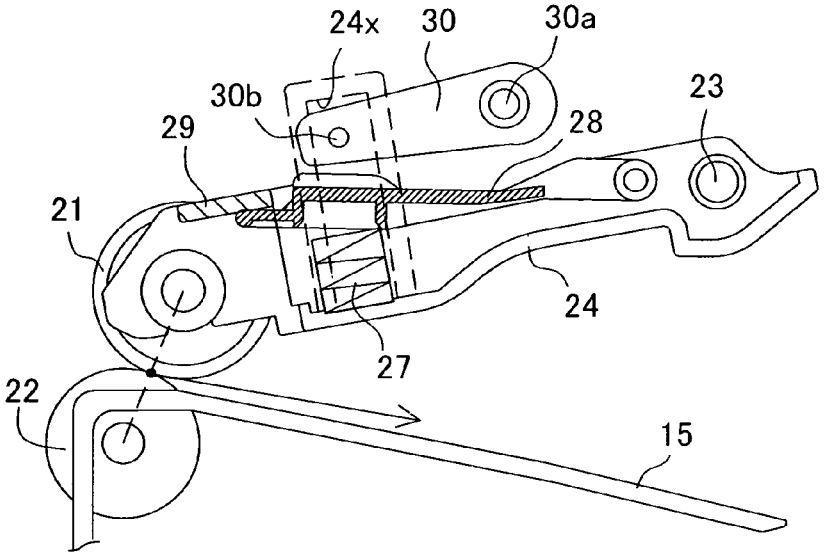
Figure 5C:
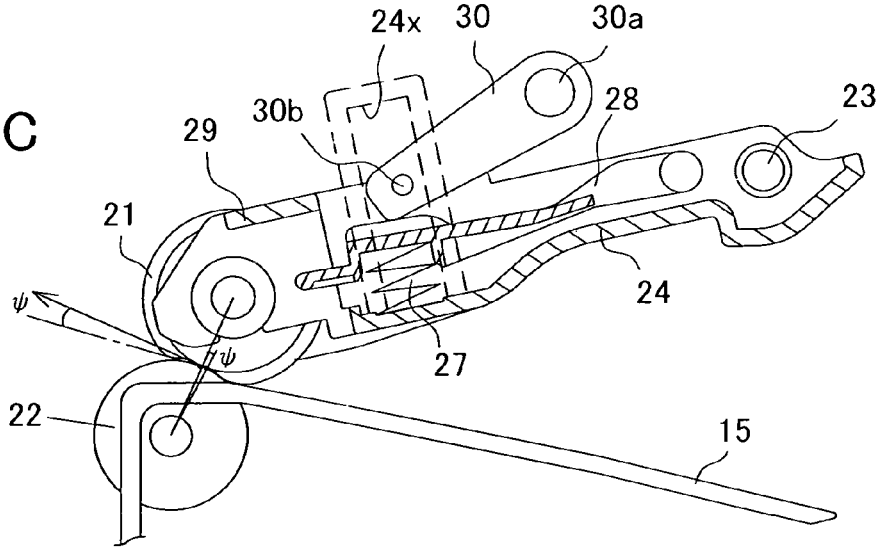

The roller bracket 24 is provided with a lifting-lowering mechanism which performs lifting-lowering motion between the waiting position Wp where the upper roller 21 is apart from the lower roller 22 and the operating position Ap where the upper roller 21 is pressure-contacted to the lower roller 22. FIGS. 5A to 5C illustrate the lifting-lowering mechanism. As illustrated in FIG. 5A, a lifting-lowering lever 30 is arranged within a movement trajectory of the roller bracket 24 which swings about the swing pivot 23. A base end portion of the lifting-lowering lever 30 is swingably supported by a rotary shaft 30*a*. The rotary shaft 30*a* is connected to a lifting-lowering motor SM via a sector-shaped gear 31. Accordingly, the lifting-lowering lever 30 is configured to be rotated (swung) within a predetermined angle range owing to rotation of the lifting-lowering motor SM.

An operation pin 30*b* is integrally formed at a top end portion of the lifting-lowering lever 30. An engagement receiving portion (long groove) 24*x* which is engaged with the operation pin 30*b* is formed at the roller bracket 24. When the operation pin 30*b* is engaged with the engagement receiving portion 24*x* as illustrated in FIG. 5A, the roller bracket 24 is located at the waiting position. When the operation pin 30*b* is in a state of being apart from the engagement receiving portion 24*x*, the roller bracket 24 is located at the operating position where the upper roller 21 is pressure-contacted to the lower roller 22 owing to own weight.

Further, when the operation pin 30*b* depresses a movable bar 28, a pressurizing spring 27 is compressed and a spring force thereof is added to the roller bracket 24 as a pressure-contact force between the upper roller 21 and the lower roller 22. Thus, when the lifting-lowering lever 30 is displaced owing to angle control of the lifting-lowering motor SM from a state of FIG. 5A to states of FIGS. 5B and 5C, the upper roller 21 shifts from a state of being apart from the lower roller 22 to a state of being pressure-contacted thereto with a low pressurization force and a state of being pressure-contacted thereto with a high pressurization force. A stopper piece 29 in FIGS. 5A to 5C is arranged at the roller bracket 24 to restrict the upper limit of swing motion of the movable bar 28.

According to the above configuration, when the lifting-lowering motor SM rotates in a predetermined direction (clockwise direction in FIGS. 5B and 5C), the lifting-lowering lever 30 moves to lift the roller bracket 24 in a direction in which the upper roller 21 is to be apart from the lower roller 22. Accordingly, the roller bracket 24 is lifted and moved to the waiting position as being engaged with a stopper (not illustrated) and held at the waiting position with loads of the motor, a transmitting mechanism, and the like. When the lifting-lowering motor SM rotates in the opposite direction, the lifting-lowering lever 30 rotates in the counterclockwise direction in FIG. 5A. Accordingly, the roller bracket 24 rotates about the swing pivot 23 in a direction to drop (fall) owing to own weight, so that the upper roller 21 is pressure-contacted to the lower roller 22.

Along with roller lifting-lowering, the roller drive motor RM transmits rotation to the upper roller 21. The roller drive motor RM is structured with a motor capable of rotating forwardly and reversely. In this case, the upper roller 21 is controlled with a first method or a second method described in the following.

According to the first method, the upper roller 21 is rotated in the sheet discharging direction in a state of being pressure-contacted to the lower roller 22 to discharge a sheet through the sheet discharging port 13. When the leading end of the sheet proceeds to the roller nipping section, the sheet is conveyed in the sheet discharging direction as receiving conveyance forces from both of the sheet discharging roller 14*c* and the reversing roller 20.

Next, when the tailing end of the sheet left from the sheet discharging port 13 (right after occurrence of a detection signal of the discharge sensor Se2), the rotating direction of the upper roller 21 is reversed. Accordingly, at the same time when the sheet tailing end drops from the sheet discharging port 13 to the processing tray 15, the sheet leading end is reversely conveyed by the upper roller 21. This sheet discharging method is adopted for control when a first sheet is introduced to the processing tray 15 (when friction between sheets does not exist). Here, the pressure-contact force between the upper roller 21 and the lower roller 22 is set as the high pressurization force (in a state of FIG. 5C).

According to the second method, when a preceding sheet is already stacked on the lower roller 22, it is in a waiting state for a sheet to be discharged through the sheet discharging port 13 while the upper roller 21 is kept at the waiting position Wp. At the timing when the tailing end of the sheet is fed out through the sheet discharging port 13, the upper roller 21 is lowered from the waiting position Wp to the operating position Ap. Along with the roller lowering action, the roller drive motor RM is rotated in the direction opposite to the sheet discharging direction. Accordingly, the tailing end of the sheet fed out through the sheet discharging port 13 drops to the processing tray 15 and the sheet is conveyed with the tailing end side in the lead toward the tailing end regulating stopper 18 with the conveyance force received from the upper roller 21. Here, the pressure-contact force between the upper roller 21 and the lower roller 22 is set to the low pressurization force (in a state of FIG. 5B).

In the abovementioned configuration of the present invention, the upper roller 21 is lifted and lowered among the waiting position, the pressure-contact position with low pressurization, and the pressure-contact position with high pressurization by the lifting-lowering lever 30 separately arranged from the roller bracket 24 around the swing pivot 23. Alternatively, it is possible to arrange a spring clutch at the swing pivot 23 of the roller bracket 24 and to rotate a rotary shaft (rotary collar or the like) in forward and reverse directions via the spring clutch. Accordingly, when rotation occurs in a direction to compress the spring clutch, the roller bracket 24 is lifted from the pressure-contact position to the lifted positing. When rotation occurs in a direction to release the spring clutch, the roller bracket 24 is lowered from the lifted position to the pressure-contact position. In order to adjust the pressure-contact force in two steps being high and low, a pressurizing mechanism (pressurizing lever or the like) to pressurize the roller bracket 24 with a spring pressure may be added.

Next, configurations of the upper roller 21 and the lower roller 22 will be described with reference to FIG. 4B. As described above, the upper roller 21 is moved between the operating position Ap to be pressure-contacted to the lower roller 22 and the waiting position Wp to be apart therefrom. At the operating position Ap, the pressure-contact force is adjustable between the low pressurization state and the high pressurization state. First, the configuration of the upper roller 21 will be described. The upper roller 21 is configured by combination of a large-diameter roller body 21*a* and a small-diameter roller body 21*b*. The large-diameter roller body and the small-diameter roller body are arranged in the sheet width direction in combination of one or more pairs thereof. In FIG. 4B, the large-diameter roller bodies 21*a* and the small-diameter roller bodies 21*b* are arranged as centering at the sheet center having the same distance therefrom. Here, the large-diameter roller body 21*a* is arranged outside the small-diameter roller body 21*b*.

Thus, the upper roller 21 is structured with the large-diameter roller bodies and the small-diameter roller bodies in a bilaterally symmetric manner against the sheet center. The large-diameter roller body 21*a* has an outer diameter being larger than that of the small-diameter roller body 21*b* by Δd and is structured with a soft member such as sponge and soft rubber. Meanwhile, the small-diameter roller body 21*b* is smaller than the large-diameter roller body 21*a* by Δd and is structured with a hard member such as synthetic resin. Thus, the upper roller 21 is configured to have different outer diameters. In contrast, the lower roller 22 is structured with a relatively hard material having the same outer diameter.

Figure 6A:
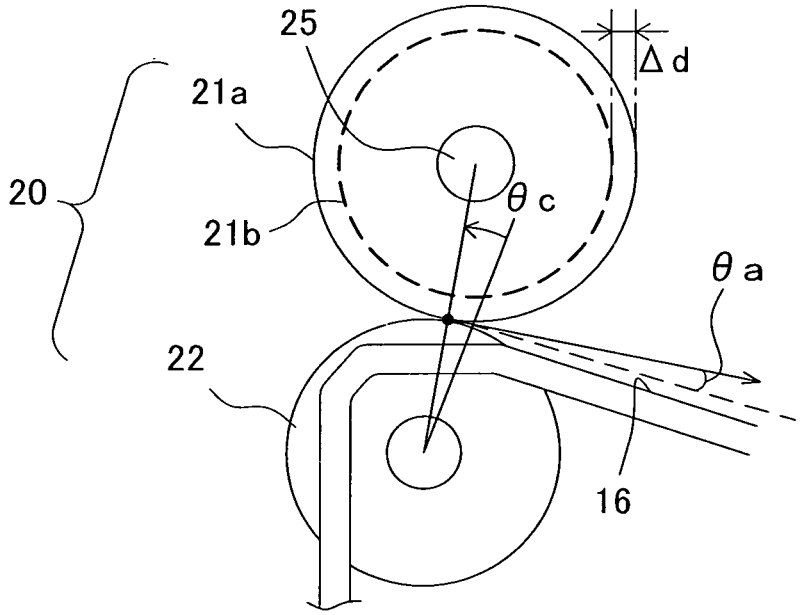
Figure 6B:
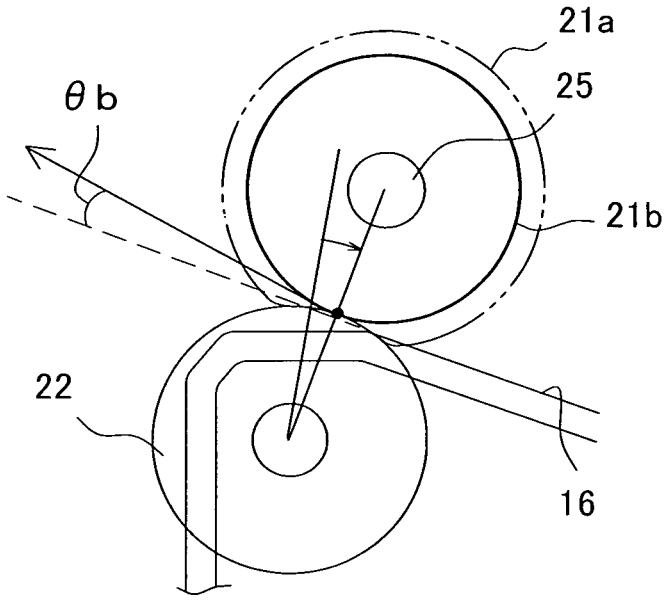

FIG. 6A illustrates a state in which the large-diameter roller body 21*a* of the upper roller 21 and the lower roller 22 are pressure-contacted. FIG. 6B illustrates a state in which the small-diameter roller body 21*b* of the upper roller 21 and the lower roller 22 are pressure-contacted. Here, FIG. 6A indicates a low pressurization state and FIG. 6B indicates a high pressurization state.

As illustrated in FIG. 6A, the large-diameter roller body 21*a* is set to have hardness so that the circumference of the large-diameter roller body 21*a* is pressure-contacted to the lower roller 22 without being elastically deformed under conditions of the low pressurization force without the pressurization force due to the above-mentioned lifting-lowering lever 30 being applied. Further, as illustrated in FIG. 6B, under conditions of the high pressurization force with an action of the lifting-lowering lever 30, the small-diameter roller body 21*b* is pressure-contacted to the lower roller 22 while the large-diameter roller body 21*a* is elastically deformed. Here, as described above, the lower roller 22 is arranged at the position opposed to the upper roller 21 as being structured with a hard material like synthetic resin such as derlin and nylon. The lower roller 22 is formed to have the same outer diameter. Here, the hard material denotes a material having hardness on the order of conveying a sheet in a state of approximately maintaining the outer diameter without having large elastic deformation even when the high pressurization force is applied from the upper roller 21.

Thus, the outer diameter difference (Δd) and the hardness difference between the large-diameter roller body 21*a* and the small-diameter roller body 21*b* are set so that the large-diameter roller body 21*a* is pressure-contacted to the lower roller 22 without being elastically deformed when being pressure-contacted to the lower roller 22 with the low pressurization force while the small-diameter roller body 21*b* is not pressure-contacted to the lower roller 22 as forming a space (gap) thereto (state of FIG. 6A). In contrast, when being pressure-contacted to the lower roller 22 with the high pressurization force, the large-diameter roller body 21*a* is elastically deformed and is pressure-contacted to the lower roller 22 along with the small-diameter roller body 21*b* (state of FIG. 6B).

When the large-diameter roller body 21*a* is pressure-contacted to the lower roller 22 without being elastically deformed as illustrated in FIG. 6A, contact area therebetween is small and a conveyance force to be applied by roller rotation is small. This is to suppress the following problem. In the case that a sheet is stacked on the lower roller 22, a sheet is fed through the sheet discharging port 13 thereon, and the sheet is to be conveyed by the upper roller 21 in the direction opposite to the sheet discharging direction, the stacked sheet and the introduced sheet are frictionally slid to each other. At that time, a large roller pressure-contact force causes ink friction as image ink being in friction between the mutual sheets. In addition, a sheet face gets dirty with ink adherent to a roller surface or the like.

Further, in the illustrated apparatus, a roller pressure-contact angle is set so that a sheet is conveyed approximately at the same direction as a sheet placement face of the sheet placement base 16 as the sheet conveying direction being illustrated by an arrow in FIG. 6A in the state that the large-diameter roller body 21*a* is engaged with the lower roller 22 without being deformed. That is, an angle θa illustrated in FIG. 6A is set to be zero or to be close to zero. This is to reduce friction between the sheet introduced to the processing tray 15 and the stacked sheet. Such reduction of a frictional force between the mutual sheets is especially effective when images are formed at high speed by the image forming apparatus A at the upstream side or when characteristics of ink for image forming provides printing conditions under which ink friction is easily caused.

When the large-diameter roller body 21*a* is pressure-contacted to the lower roller 22 as being elastically deformed as illustrated in FIG. 6B, contact area therebetween is large and a conveyance force to be applied to sheets by roller rotation is large. Further, in the illustrated apparatus, conveyance is performed with the conveying direction being upwardly shifted from the sheet placement face of the sheet placement base 16 by an angle θb in FIG. 6B.

Thus, by structuring the upper roller 21 with the large-diameter roller body 21*a* and the small-diameter roller body 21*b* and varying the pressurization force to be applied to the respective rollers in two steps being high and low, the sheet fed to the sheet discharging port 13 can be conveyed while varying the conveying mechanism as illustrated in FIGS. 6A and 6B in accordance with a conveyance mode. That is, when the sheet fed to the sheet discharging port 13 is introduced to the processing tray 15 with switch-back conveying, ink friction between the mutual sheets can be prevented. When the sheet is conveyed from the sheet discharging port 13 to the stack tray 40, the sheet is conveyed toward the tray with the sheet discharging direction being set in a parabola direction in an upward posture, so that the sheet on the tray can be discharged relatively further.

The reason why the reversing roller 20 is structured with the pair of large-diameter and small-diameter rollers is as follows. The reversing roller 20 discharges a sheet fed to the sheet discharging port 13 respectively to the stack tray 40 and the processing tray 15 in a first sheet discharge mode and a second sheet discharge mode which are described later. In the first sheet discharge mode, the sheet fed to the sheet discharging port 13 is conveyed to the stack tray 40 at the downstream side by nipping one by one with the upper roller 21 and the lower roller 22. Here, the first sheet discharge mode includes different sheet discharging operations being jog discharging to perform jog sorting of sheets on the stack tray 40 for each bundle and straight discharging to perform discharging without sorting.

Accordingly, in the first sheet discharge mode, since sheets are nipped between the upper roller 21 and the lower roller 22 one by one, reliable conveyance can be performed to the downstream side owing to roller rotation without occurrence of slippage between the rollers and a sheet. In the second sheet discharge mode, the sheet fed from the sheet discharging port 13 is introduced onto the upmost sheet which is previously stacked, and then, the sheet is conveyed, as sliding on the upmost sheet, in the sheet discharging direction and subsequently in the opposite direction to the sheet discharging direction as being pressed by the upper roller 21.

As described above, regarding the different conveyance modes, according to the nip conveyance in the first sheet discharge mode, a sheet (sheet bundle in a later-mentioned bundle discharge mode) can be discharged and accommodated reliably in the stack tray 40 at the downstream side with a strong pressure-contact force. In the second sheet discharge mode, slippage between mutual sheets is unavoidable. In this case, since there is a fear that ink friction occurs with an image formed on a sheet face, it is preferable that a sheet is conveyed with a weak pressure-contact force.

Further, for example, from a viewpoint of compatibility (adhesiveness) with image forming ink, there is a case that a roller surface is coated. Regarding the illustrated rollers, a surface-hardening process such as ceramic coating and a fluorine coating is performed on each surface of the small-diameter roller body 21*b* and the lower roller 22 which conveys a sheet with nipping. According to the above, there is not a fear that a subsequent sheet gets dirty with ink friction as being adhesive to a roller surface even when ink on the sheet is insufficiently fixed.

Further, in the later-mentioned second sheet discharge mode, a sheet fed from the sheet discharging port 13 are stacked on the sheet placement base 16 and the lower roller 22 in a lamination manner, and then, a sheet fed from the sheet discharging port 13 is conveyed in a switch-back manner by the upper roller 21, on the upmost sheet, in the sheet discharging direction and subsequently in the opposite direction to the sheet discharging direction. The upper roller 21 is required to perform conveyance to a predetermined post-processing position while preventing strong friction between the sheet stacked on the sheet placement base 16 and the sheet introduced from the sheet discharging port 13. Here, there is a fear that image ink friction occurs when friction occurs between mutual sheets as well as a problem that an ink layer adherent to a roller surface adheres to a sheet face. In order to solve image shifting and dirty marks between sheets, the upper roller 21 is structured with a large-diameter roller being a soft roller made of sponge or the like. In addition, a roller pressure-contact angle θc (see FIG. 6A) is set so that a roller contact point is moved in a direction where a sheet follows along the face of the sheet placement base 16.

Further, regarding the sheet introduced to the processing tray 15, only the large-diameter roller body 21*a* is pressure-contacted to the sheet face and a gap is formed against the small-diameter roller body 21*b* without being pressure-contacted thereto. Accordingly, contact area between the roller and the sheet is small and the pressurization force is set at the low pressurization force. Therefore, static electricity occurring between mutual sheet (between a stacked sheet and an introduced sheet) is slight, so that conveyance of a subsequent sheet is not disturbed by accumulated static electricity.

In the above, description is performed on the configuration that a sheet bundle is conveyed to the stack tray 40 at the downstream side by the reversing roller mechanism 20 after a binding process is performed on the sheet bundle stacked on the processing tray 15. However, it is also possible to arrange conveyer means which discharges a sheet bundle from the processing tray 15 along with the reversing roller mechanism 20.

As illustrated in FIG. 4A, the tailing end regulating stopper 18 is structured with a plate-shaped member which performs regulation with abutting against a sheet tailing end and is arranged at one position or a plurality of positions as being distanced in the sheet width direction. The tailing end regulating stopper 18 is arranged at a sheet tailing end edge along with the post-processing means such as a staple unit 17. Accordingly, when the staple unit 17 is arranged movably in the sheet width direction, the tailing end regulating stopper 18 is configured to be movable as well in the sheet width direction as being interlocked with the staple unit 17. In contrast, when the staple unit 17 is fixedly arranged without being moved in the sheet width direction, it is also possible to arrange the tailing end regulating stopper 18 integrally with the staple unit 17.

[Stack Tray]

Figure 8:
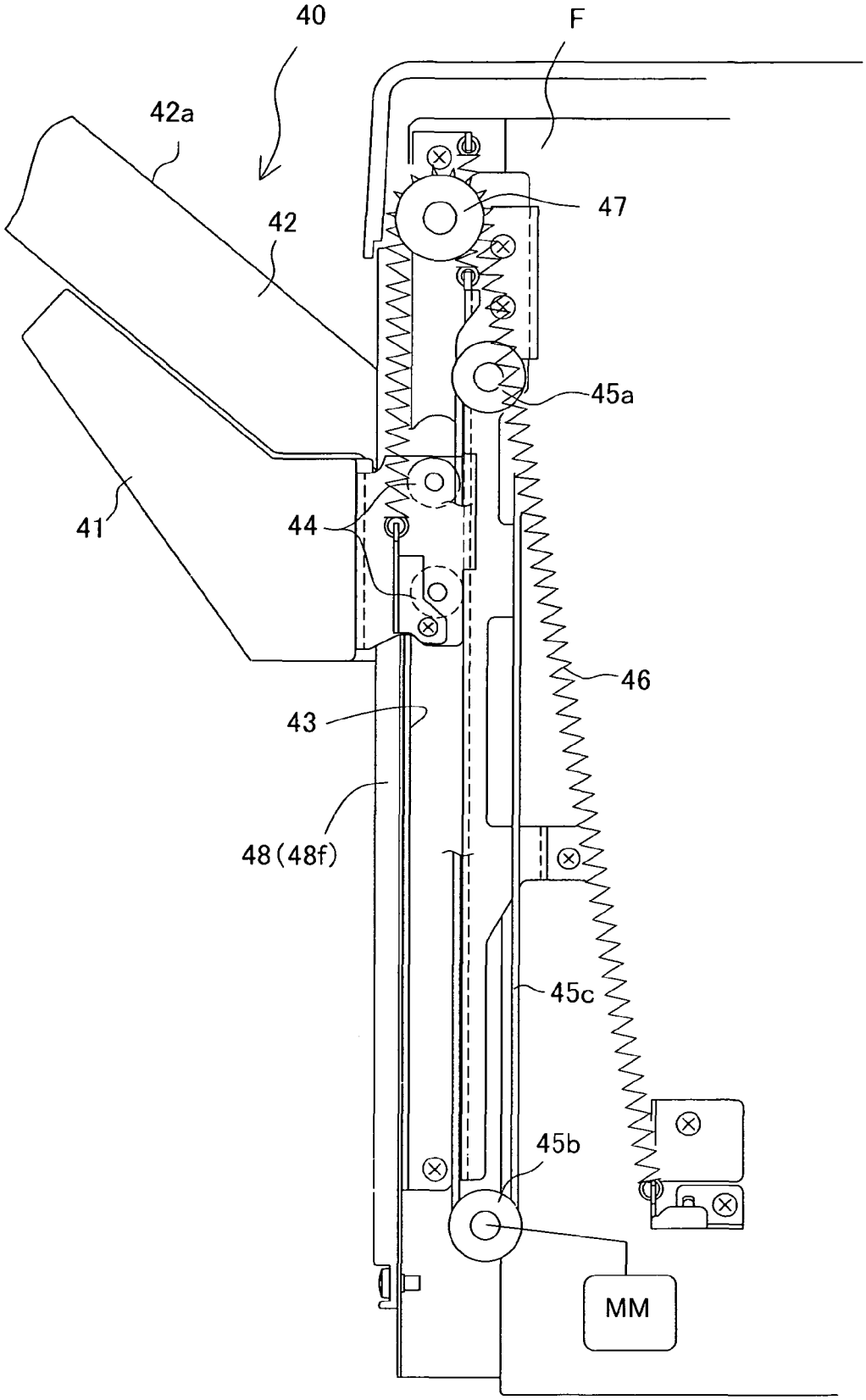
FIG. 8 is an explanatory view of a lifting-lowering mechanism of the stack tray.

Next, the stack tray will be described. As illustrated in FIGS. 2 and 8, the stack tray 40 is arranged at the downstream side of the sheet discharging port 13 of the sheet conveying path 11. The abovementioned processing tray 15 is arranged at the downstream side of the sheet discharging port 13. The stack tray 40 is arranged at the downstream side of the sheet discharging port 13 and the discharging port 13 of the processing tray 15. Here, a single sheet is discharged through the sheet discharging port 13 and a sheet bundle is discharged through the discharging port 13, so as to be stored at the stack tray 40 in both cases.

In the illustrated case, the sheet discharging port 13 and the discharging port 13 are arranged substantially at the same position. This is because of performing the first sheet discharge mode to store a sheet fed from the sheet discharging port 13 directly at the stack tray 40 and the second sheet discharge mode to perform storing at the stack tray 40 from the discharging port 13 after a sheet fed to the sheet discharging port 13 is conveyed to the processing tray 15 and a post-process is performed thereon. Here, the sheet discharging port 13 and the discharging port 13 are denoted by the same numeral.

The stack tray 40 is structured with a tray base 41 and a sheet placement tray 42. The tray base 41 is supported by the apparatus frame F to perform lifting-lowering motion at a predetermined stroke. The sheet placement tray 42 is configured to be a tray shape having a tray face on which sheets are stacked and stored. The sheet placement tray 42 is supported by the tray base 41. Here, a later-mentioned jog shifting mechanism is arranged so that the sheet placement tray 42 performs jog shifting by a predetermined amount in the sheet width direction against the tray base 41.

[Tray Lifting-Lowering Mechanism]

FIG. 8 illustrates a lifting-lowering mechanism of the stack tray 40. A guide rail 43 (see FIG. 8) is arranged at the apparatus frame F vertically in the stacking direction. Slide rollers 44 fixed to a joint portion (joint plate) of the tray base 41 are fitted to the guide rail 43. The guide rail 43 is structured with bar-shaped guide, channel steal, H-shaped steel, or the like and the tray base 41 is slidably fitted thereto.

The tray base 41 is configured with a frame structure having strength for supporting loads of the sheet placement tray 42 and sheets stacked thereon and is cantilever-supported by the guide rail which is similarly stiff. Further, a suspension pulley 45*a* and a winding pulley 45*b* are axially fixed to the apparatus frame F respectively at an upper end part and a lower end part of the guide rail 43. A tow member 45*c* such as a wire and a geared belt is routed between both the pulleys. A winding motor MM is connected to the winding pulley 45*b* via a deceleration mechanism.

Further, a coil spring 46 for weight lightening is routed between the tray base 41 and the apparatus frame F. That is, one end (lower end in FIG. 8) of the spring 46 is fixed to the apparatus frame F and the other end (upper end in FIG. 8) is fixed to the tray base 41 via a tow pulley 47. Initial tension is applied to the spring 46. Accordingly, the sheet placement tray 42 and sheets stacked thereon are lightened in weight in accordance with an elastic force of the coil spring 46 and load torque of the winding motor MM is reduced. Further, it is also possible to adopt a weight lightening mechanism which hangs a weight from a hanging pulley instead of a coil spring.

[Sheet Placement Tray]

The sheet placement tray 42 includes a sheet placement face 42*a* on which sheets fed from the sheet discharging port 13 at the upper side are placed in a lamination manner. The sheet placement face 42*a* may be horizontally arranged. Here, the sheet placement face 42*a* is inclined by a predetermined angle. This is for correcting the stacked sheets in posture to the tailing end side owing to own weight. It is preferable that the inclination angle of the sheet placement face 42*a* is approximately in a range between 30° and 45° against a horizontal surface. When the inclination angle is 30° or less, it is difficult to perform sheet correction in posture. When the inclination angle is 45° or more, there is a fear that a curled sheet is overturned at the time of entering the sheet placement tray 42. The sheet placement tray 42 is supported by the tray base 41 and performs lifting and lowering motion along the guide rail 43. Further, a fence plate 48 having a tailing end regulating face 48*f* which regulates a sheet tailing end is arranged at the apparatus frame F. The fence plate 48 may have a wall face structure of being fixed to the apparatus frame F. In FIG. 8, since the sheet placement tray 42 is configured to perform jog shifting by a predetermined amount in the sheet width direction, the fence plate 48 is configured to perform jog shifting as well along with the sheet placement tray 42. The structure thereof will be described later.

[Jog Shifting Mechanism]

Figure 9:
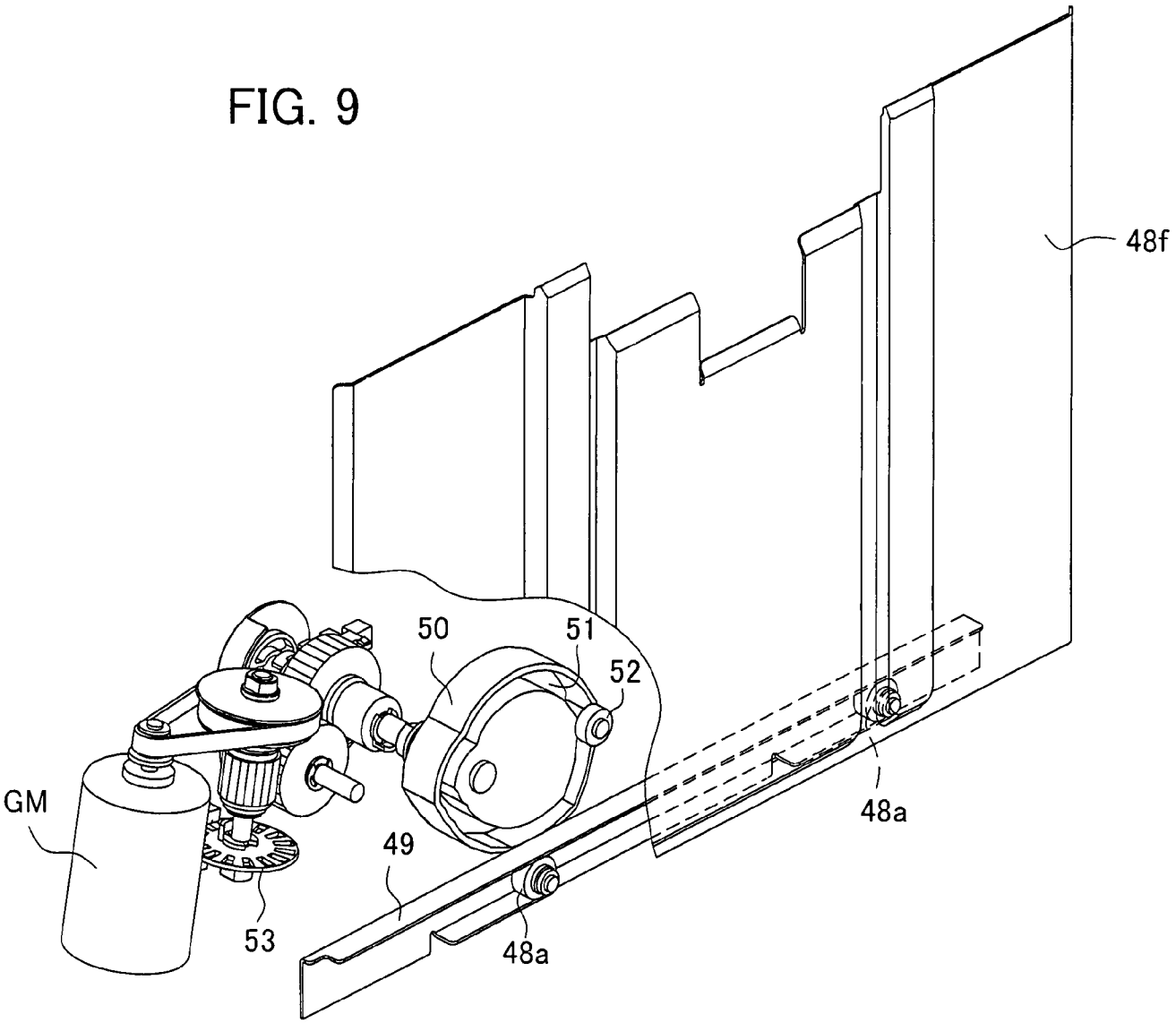
FIG. 9 is an explanatory view of a jog shifting mechanism of the stack tray.

Next, a jog shifting mechanism of the sheet placement tray 42 supported by the tray base 41 will be described with reference to FIG. 9. In FIG. 9, the sheet placement tray 42 is located at the front side (front face side) and the apparatus frame F is located at the back side (back face side). With such a layout, the sheet placement tray 42 is connected to the fence plate 48 with concave-convex fitting as being movable in the lateral direction (sheet width direction) in FIG. 9. A convex portion is formed at one of the sheet placement tray 42 and the fence plate 48 and a concave portion is formed at the other thereof, so that both thereof are integrated with fitting (tenon fitting or the like). Slide rollers 48*a* are arranged at the fence plate 48 as being fitting-supported by a lateral guide rail 49. The lateral guide rail 49 is fixed to the apparatus frame F in the sheet width direction.

With such a configuration, when either the fence plate 48 or the sheet placement tray 42 is moved in the sheet width direction, both thereof are concurrently moved by the same amount in the same direction. In the illustrated apparatus, a jog shifting motor GM and a cam member 50 connected to the jog shifting motor GM are arranged at the apparatus frame F. A cam pin 52 is fitted to a cam groove 51 which is formed at the cam member 50 (eccentric cam in FIG. 9). The cam pin 52 is arranged at the fence plate 48 to be integrated therewith. Here, in the jog shifting motor GM, an encoder 53 is arranged at a rotary shaft thereof, so that a rotational angle thereof is controlled. Further, a home position sensor (not illustrated) is arranged at the rotary shaft.

When the jog shifting motor GM rotates by a predetermined angle, the cam member (eccentric cam in FIG. 9) 50 connected thereto rotates by a predetermined angle. Then, the cam pin 52 fitted to the cam groove 51 moves the fence plate 48 integrated therewith in the sheet width direction by a predetermined amount. In accordance with the movement, the sheet placement tray 42 is also moved integrally in the same direction.

[Sheet Level Detecting Mechanism]

Figure 10:
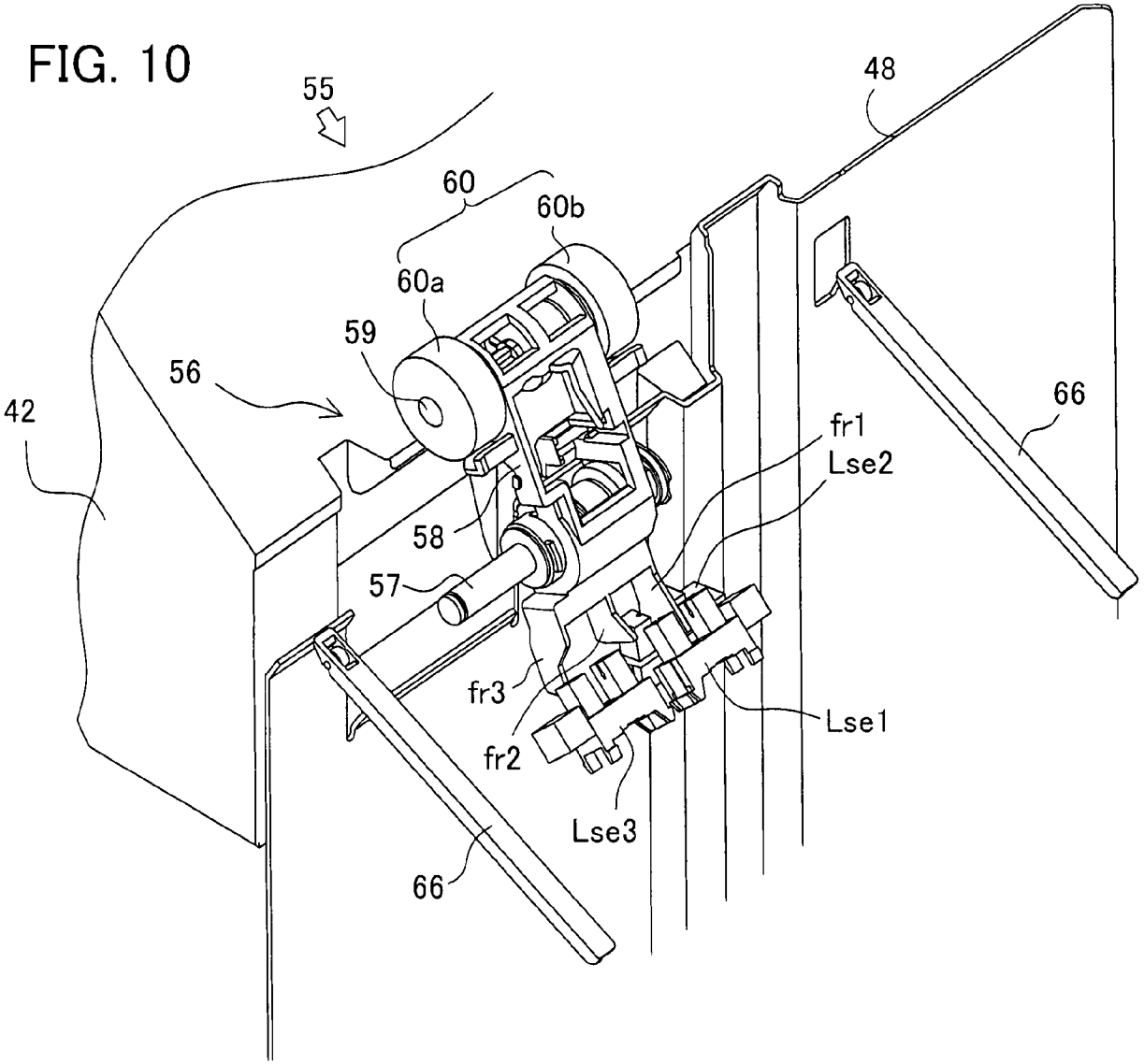
FIG. 10 is an explanatory view of a perspective structure of a sheet holding unit of the stack tray.
Figure 13A:
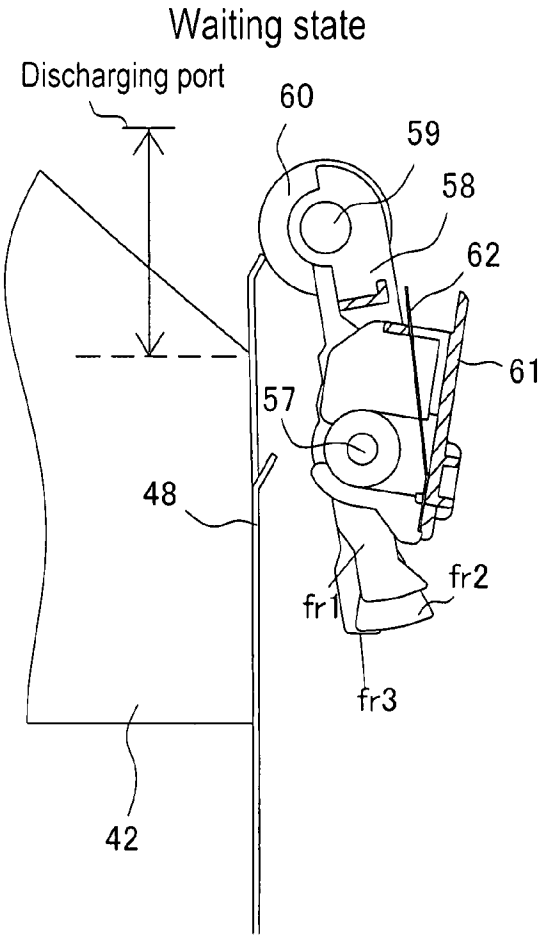

The abovementioned stack tray 40 is provided with a level detecting mechanism 55 which detects a height position of stacked sheets and a sheet tailing end supporting mechanism 65. The level detecting mechanism 55 detects a height level of the upmost sheet among the sheets stacked on the sheet placement tray 42. As FIG. 10 illustrates a perspective structure thereof, the level detecting mechanism 55 is configured so that a sheet holding unit 56 proceeds to and retracts from the sheet placement tray 42 between a waiting position (state of FIG. 13A) for retracting from the side above the sheet placement tray 42 and an operating position (states of FIGS. 13B and 13C) for engaging with the upmost sheet.

That is, the level detecting mechanism 55 is on standby at the waiting position retracting from a trajectory of a sheet to be stored at the sheet placement tray 42 as dropping through the sheet discharging port 13 at the upper side and detects a height position as being engaged with the upmost sheet after the sheet is stored onto the sheet placement tray 42. Here, there is a case that the sheets stacked on the sheet placement tray 42 provides a higher level than a substantial height owing to rising as being influenced by curling, air layers between sheets, and later-mentioned staple needles. Accordingly, the level detecting mechanism 55 includes pressurizing means for sheets. In the illustrated apparatus, the pressurizing means has the following configuration as a sheet holding unit 56.

A swing rotary shaft 57 is bearing-supported by the apparatus frame F. A swing arm 58 is swingably supported at a base end portion by the swing rotary shaft 57. A roller rotary shaft 59 is axially supported by the top end portion of the swing arm 58. A frictional rotor 60 (hereinafter, also called sheet pressurizing member 60*a*, 60*b*) is fixed to the roller rotary shaft 59.

The swing rotary shaft 57 and the swing arm 58 having a set arm length are arranged so as to swing the frictional rotor 60 between a detecting position above the sheet placement tray 42 and a waiting position outside the sheet placement tray 42 as sandwiching the fence plate 48 therebetween. The illustrated frictional rotor 60 is structured with a right-left pair of roller bodies which are mutually distanced. The roller pair is rotated so that a sheet stored at the sheet placement tray 42 is raked to have a tailing end thereof abutted to the tailing end regulating face 48*f*. For the frictional rotor 60, a drive pulley is arranged at the swing rotary shaft 57 and a roller drive motor RM2 (see FIG. 11) is connected to the drive pulley via a transmission belt 60V.

Figure 11:
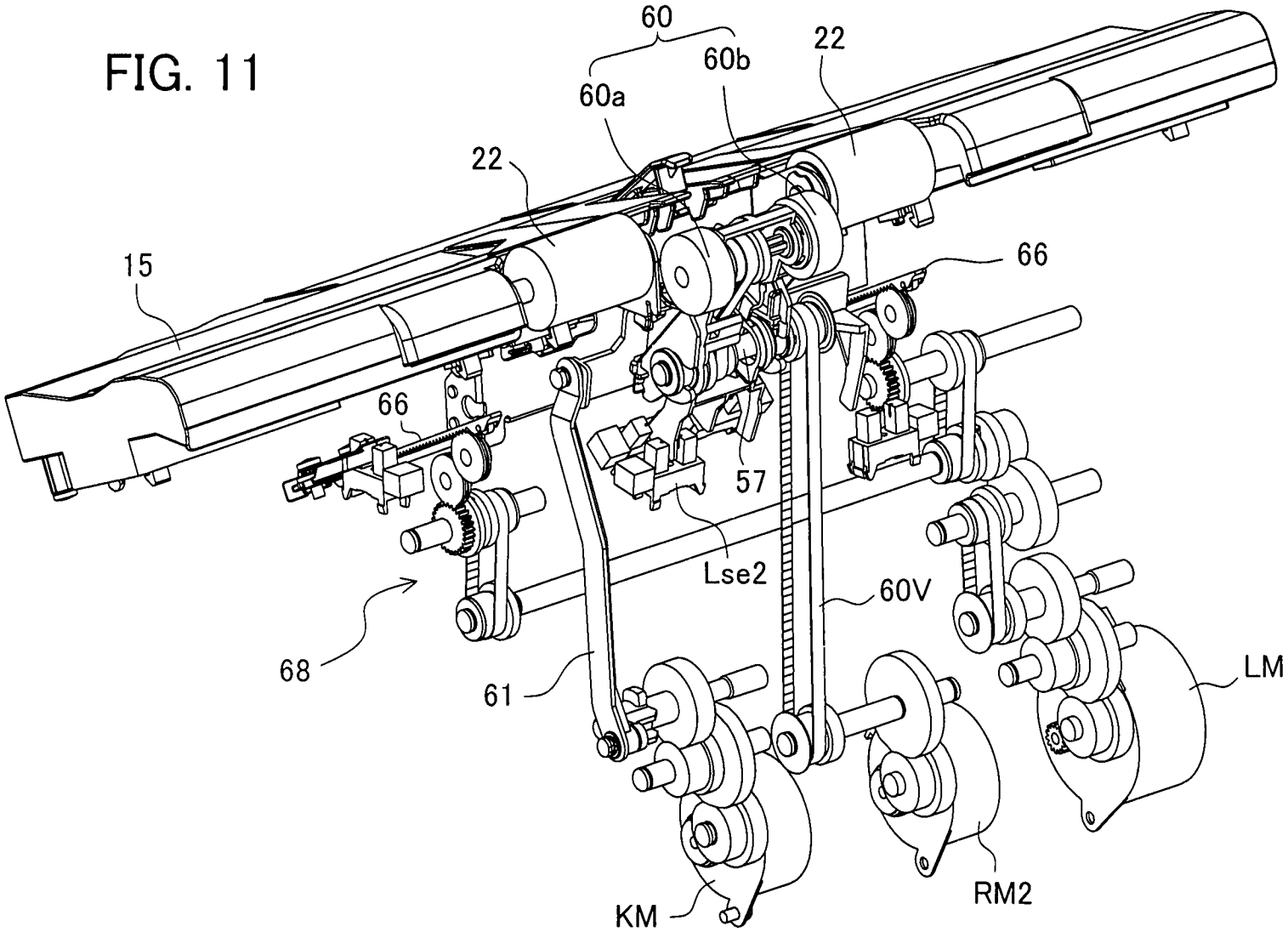
FIG. 11 is an explanatory view of a drive mechanism of the stack tray as illustrating a drive mechanism of a sheet tailing end supporting lever, a drive mechanism of a friction rotor of the sheet holding unit, and a drive mechanism which shifts the sheet holding unit in posture.
Figure 13B:
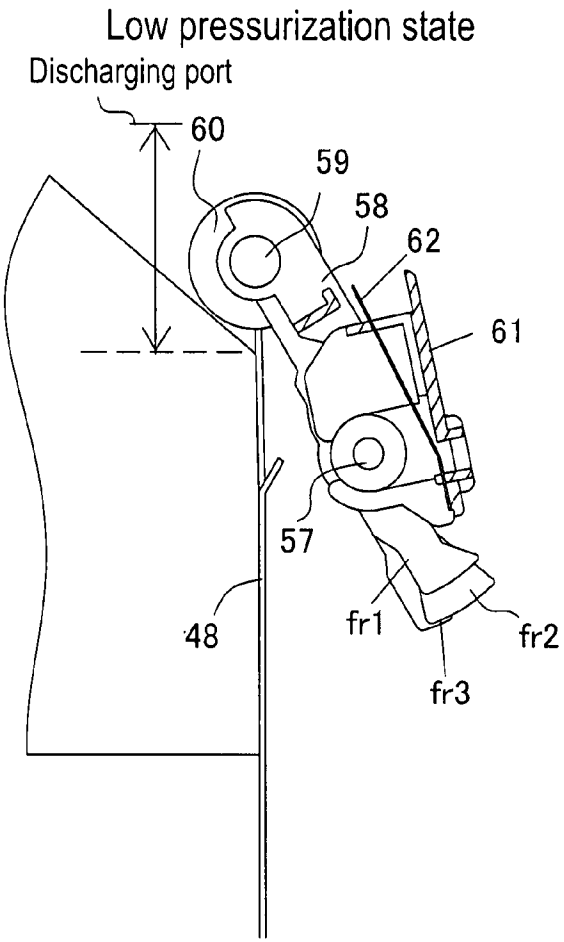
Figure 13C:
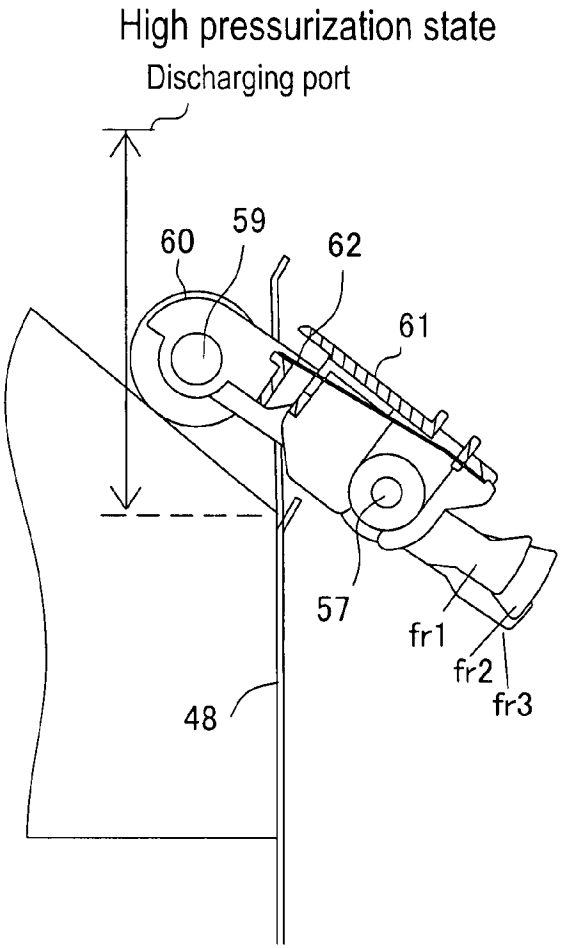

As illustrated in FIG. 11, the sheet holding unit 56 is arranged below (the lower roller 22 of) the reversing roller 20 which is arranged at the sheet discharging port 13. The sheet holding unit 56 is structured with a swinging mechanism which moves from the outside of the sheet storage trajectory between the discharging port 13 and the upmost sheet to a position above the sheet. As illustrated in FIG. 10, the illustrated swinging mechanism includes the swing arm 58 (e.g., roller bracket) swingable about the swing rotary shaft 57 and the frictional rotor 60 (raking roller body; hereinafter, called a roller body) which is rotatably bearing-supported by the swing arm 58. The illustrated roller body 60 is structured with a pair of roller bodies 60*a*, 60*b* which are mutually distanced in the sheet width direction. Owing to swing motion of the swing arm 58, the roller body 60 mounted on the top end thereof performs reciprocating motion between the waiting position (FIG. 13A) at the inside of the tailing end regulating face (fence plate) 48*f* and a sheet engaging position (the detecting position; FIGS. 13B and 13C) for engaging with the upmost sheet on the sheet placement tray 42.

A press lever 61 is loosely fitted to the swing rotary shaft 57 via a collar member. A sheet holding motor KM illustrated in FIG. 11 is connected to the press lever 61. Then, a pressurizing spring 62 is fixed to the press lever 61 and a top end of the pressurizing spring 62 is arranged at a position to be engaged with the swing arm member 58. Accordingly, when the sheet holding motor KM rotates within a predetermined angle range, the press lever 61 is rotated from the state of FIG. 13A to the state of FIG. 13B. At that time, the angle is set so that a spring pressure of the pressurizing spring 62 is not exerted. Accordingly, the upmost sheet is pressed by own weight of the sheet holding unit 56 (the roller body 60 and the swing arm 58). Hereinafter, the above state is called a low pressurization state.

When the sheet holding motor KM is rotated further by a predetermined angle in the same direction, the press lever 61 is rotated from the state of FIG. 13B to the state of FIG. 13C. At that time, the pressurizing spring 62 is compressed and the spring force is applied to the swing arm 58. Accordingly, the roller body 60 presses the upmost sheet in a state that the spring force is added to the own weight. The spring force is set to an urging force to suppress swelling, rolling, winding, and the like of sheets which are stacked on the sheet placement tray 42.

Further, the frictional rotor 60 is structured with a rubber roller, a resin roller, or the like. When being engaged with the upmost sheet in the abovementioned low pressurization state, driving of the roller drive motor RM2 which applies a conveyance force to convey the sheet toward the tailing end regulating face 48*f* is transmitted via the transmission belt 60V.

[Sensor Configuration]

As described above, in the sheet holding unit 56 which is structured with a rotor, a flag fr for angle detection is arranged at the swing rotary shaft 57. In FIG. 10, a first flag fr1, a second flag fr2, and a third flag fr3 are arranged for setting the height position of the sheet placement tray 42 at a first storing height position H1 and a second storing height position H2. According to the flags fr1, fr2, and fr3, it is possible to detect whether the sheet height of the sheet placement tray 42 is at the previously-set first storing height position H1, at the previously-set second storing height position H2, at the upper side thereof, or at the lower side thereof.

In the above description, the sheet holding unit 56 is structured with the swing arm 58 and the frictional rotor 60 which is mounted thereon. However, not limited to such a structure, it is also possible to adopt a structure with a sheet holding pad and a swing arm which moves the holding pad from a waiting position to a detecting position, for example.

In the following, description will be performed on sheet discharge modes to store sheets at the stack tray 40, positional control of tray height in each sheet discharge mode, and a detection method of the height.

[Sheet Discharge Mode]

Next, description will be performed on the sheet discharge modes of the present invention from the sheet discharging port 13 to the stack tray 40. Control means 85 described later provides the first sheet discharge mode and the second sheet discharge mode. The first sheet discharge mode includes a sheet discharging operation to store a sheet fed to the sheet conveying path 11 to the sheet placement tray 42 through the sheet discharging port 13. Here, a straight sheet discharging operation to perform discharging sheets fed from the sheet discharging port 13 without performing collating and offsetting and a jog sheet discharging operation to store sheets fed from the sheet discharging port 13 with offsetting for each bundle are performed selectively.

In the second sheet discharge mode, sheets fed to the sheet conveying path 11 are collated and stacked on the processing tray 15 through the sheet discharging port 13 and a stapling process is performed. At that time, a corner binding process to perform staple binding at one position at a sheet corner and a center binding process to perform staple binding at two positions at a sheet center section are selectively performed.

Owing to later-mentioned control means (hereinafter, also called control CPU) 85, with the straight sheet discharging operation and the jog sheet discharging operation in the first sheet discharge mode, the height of the upmost sheet on the stack tray 40 is set at the first storing height position H1 as described below. With the corner binding operation or the center binding operation in the second sheet discharge mode, the height of the upmost sheet on the stack tray 40 is set at the second storing height position H2 as described below.

Further, owing to the control means 85, during performing the second sheet discharge mode, the sheets fed to the sheet discharging port 13 of the sheet conveying path 11 are conveyed to a binding position of the processing tray 15. At that time, the control means 85 positions the upmost sheet on the stack tray 40 at the first storing height position H1 as described below.

The first and second storing height positions H1 and H2 will be described with reference to FIG. 7. The first storing height position H1 is set at a position where height difference H1 is formed between the sheet discharging port 13 and the upmost sheet (hereinafter, also called upmost sheet face) on the sheet placement tray 42. The height difference H1 is set at a height level (height difference) for stacking several sheets with reference to a sheet fed to the sheet discharging port 13. When the height difference H1 is set high (large), there is a case that a sheet to be stored gets off-balanced owing to an elevation gap. On the contrary, when the height difference H1 is set low (small), it is required to frequently perform a tray lowering operation. Accordingly, the height difference of the first storing height position H1 is set to an appropriate value from experiments and the like in consideration of frequency of the tray lowering operations and alignment of stored sheets.

At the second storing height position H2, a sheet bundle with a binding process performed is stored from the processing tray 15 onto the upmost sheet on the sheet placement tray 42 as being dropped thereon. Here, the height difference H2 between the discharging port 13 and the upmost sheet face is set larger than a maximum allowable bundle thickness Hmax of a sheet bundle on which a binding process is performed on the processing tray 15. The height difference H2 is set in consideration of variations of stacked quantity (variations of stacked sheets due to air layers between stacked sheets, wave-shaped winding deformation, curling, and the like) with reference to the maximum allowable bundle thickness Hmax (apparatus specification), for example. In particular, when staple-bound sheet bundles are stacked on the sheet placement tray 42 (when the later-mentioned second sheet discharge mode is performed), there occurs a phenomenon that staple needle portions are stacked upward to be swelled like a heaping manner. Owing to that sheet faces of sheet bundles stacked on the sheet placement tray 42 get uneven, the second storing height position H2 is set to have the height difference H2 which is sufficiently larger than the maximum allowable bundle thickness Hmax.

Here, a tailing end supporting mechanism 65 which supports a tailing end of a dropping sheet bundle is arranged between the abovementioned storing height position H2 and the discharging port 13 of the processing tray 15 with a later-described structure. Relations among the tailing end supporting member 66, the first storing height position H1, and the second storing height position H2 will be describe with reference to FIG. 7.

The second storing height position H2 provides the height difference H2 against the discharging port 13. The tailing end supporting member 66 which supports a tailing end of a sheet bundle is arranged at a middle position of the height difference H2 as being movable to and from a side above the sheet placement tray 42. A supporting face 66*f* to support a sheet bundle which is dropped through the sheet discharging port 13 is formed at the tailing end supporting member 66. Then, the height difference Ha between the discharging port 13 and the supporting face 66*f* is set larger than the maximum allowable bundle thickness Hmax. Meanwhile, in the illustrated apparatus, height difference Hb between the supporting face 66*f* and the upmost stacked sheet face is set smaller than the maximum allowable bundle thickness Hmax.

That is, expressions being "H2=Ha+Hb" and"Ha>Hmax>Hb" are satisfied as Hmax denoting the maximum allowable sheet bundle thickness. Here, Ha is set larger (higher) than the maximum allowable sheet bundle thickness Hmax so that a sheet bundle dropped through the discharging port 13 is reliably placed on the supporting member 66. Further, consideration to reduce impact due to dropping by setting the elevation gap small to the extent possible is made for a sheet bundle which drops onto the upmost stacked sheet from the supporting face 66*f*.

In the above description of the present invention, the height position of the stack tray 40 is controlled in two steps being the first and second storing height positions H1 and H2. Not limited to two steps, controlling with more steps may be adopted. For example, for introducing a sheet to the processing tray 15 through the sheet discharging port 13, the height position of the stack tray 40 may be set to be on the same plane as the sheet placement base 16 of the processing tray 15. Similarly, for storing a sheet bundle by dropping onto the stack tray 40, it is also possible to set a third storing height position which is higher than the second storing height position H2 so that a leading end of a sheet bundle which is discharged from the third storing height position is received by the sheet placement tray face and lowering is performed to the second storing height position H2 in accordance with sheet bundle discharging.

A method of positioning the sheet placement tray 42 at the abovementioned second storing height position H2 will be described. As described above, the second storing height position H2 is set to the sum of the height difference Ha between the discharging port 13 and the supporting face 66*f* (tailing end supporting member) and the height difference Hb between the supporting face 66*f* and the upmost sheet face in the sheet placement tray 42. That is, the expression of "H2=Ha+Hb" is satisfied. Here, Ha being a design value is set to a value larger than the maximum allowable sheet bundle thickness Hmax. Meanwhile, Hb being a value smaller than the maximum allowable sheet bundle thickness Hmax is set as follows.

The height position of the sheet placement tray 42 is set by either a first height position setting as considering a bundle thickness of a sheet bundle which is waiting at the processing tray 15 at the upstream side or a second height position setting as the bundle thickness being set at a specified value.

With the first height position setting, the height difference Hb between the supporting face 66*f* and the upmost sheet face on the sheet placement tray 42 is set in consideration of a bundle thickness of a sheet bundle which is to be (or has been) stacked on the processing tray 15. That is, the height difference Hb is set with reference to the bundle thickness while determining the bundle thickness of the sheet bundle to be stored at the height difference Hb. For example, the setting is performed as satisfying an expression of "(height difference Hb)=(thickness of sheet bundle to be stored)+(clearance gap)".

In this case, (i) the bundle thickness of the sheet bundle is obtained by arranging a bundle thickness detection sensor on the processing tray 15. For example, the detection sensor detects a height position of an engaging piece which engages (not illustrated) with the upmost sheet face of the sheet bundle stacked on the processing tray 15. Alternatively, (ii) the bundle thickness of the sheet bundle is obtained by counting the number of sheets discharged onto the processing tray 15 with the image forming apparatus A or the discharge sensor Se2 and multiplying the total number by an average sheet thickness with a job end signal. Thus, the bundle thickness of the sheet bundle can be determined with a method of either (i) or (ii).

With the second height position setting, the height difference Hb between the supporting face 66*f* and the upmost sheet face on the sheet placement tray 42 is set to a specified value which is previously set. For example, the setting is performed as satisfying an expression of "(height difference Hb)=(maximum allowable sheet bundle thickness)+(clearance gap)".

[Height Position Detection]

As described above, in the sheet holding unit 56, the flag fr for angle detection is arranged at the swing rotary shaft 57. For the first to third flags fr1, fr2, and fr3, first to third sensors LSe1, LSe2, and LSe3 are attached to the apparatus frame F to detect the positions thereof respectively.

Figures 12A, 12B:
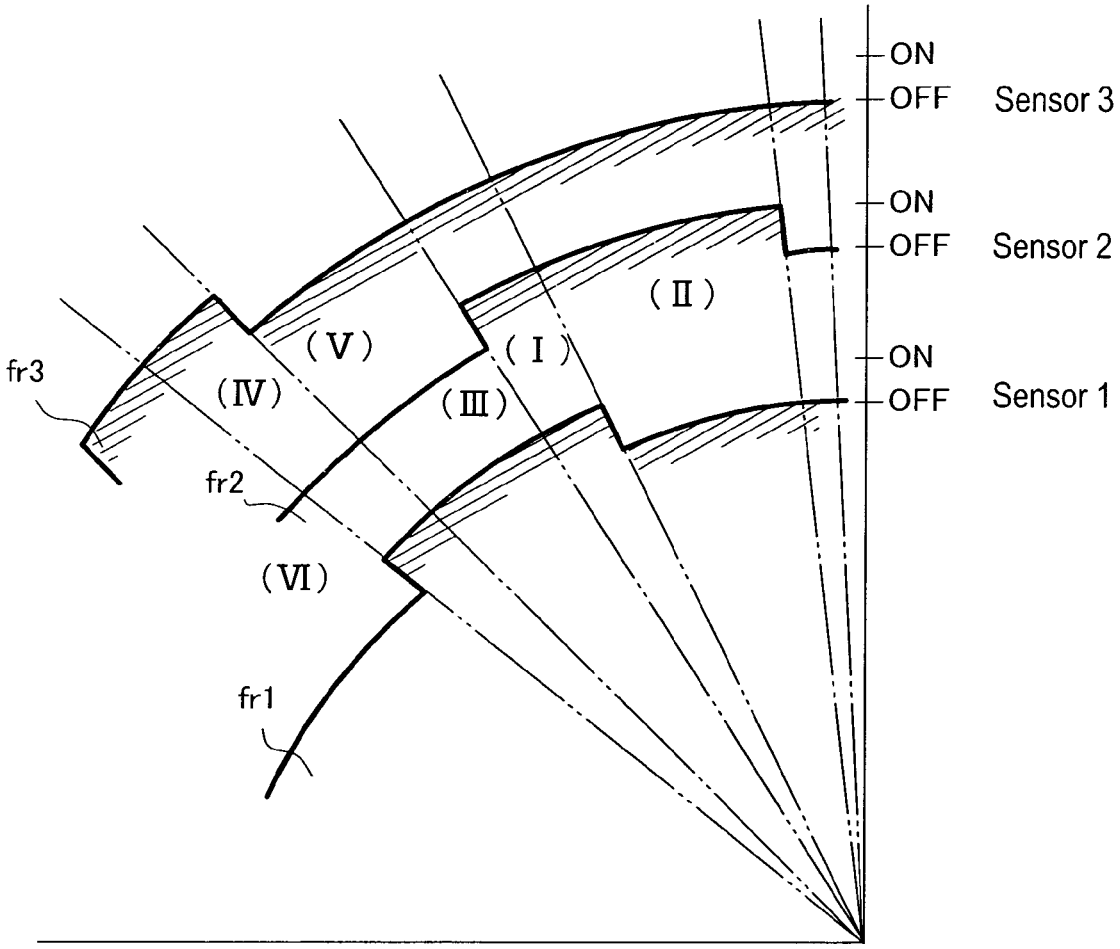
FIG. 12A illustrates shapes of sensor flags of the sheet holding unit for detecting a height level of a sheet stacked on the tray and FIG. 12B illustrates relations between sensors and tray positions.

FIG. 12 illustrates relations between rotational angles of the swing rotary shaft 57 and the respective flags. The first to third sensors LSe1, LSe2, and LSe3 are attached to the apparatus frame F to detect the three flags. According to positional relations between the sensors and flags as illustrated in FIG. 12, the height level of sheets stacked on the sheet placement tray 42 is detected based on ON/OFF of the first sensor LSe1, ON/OFF of the second sensor LSe2, and ON/OFF of the third sensor LSe3.

Figure 7:
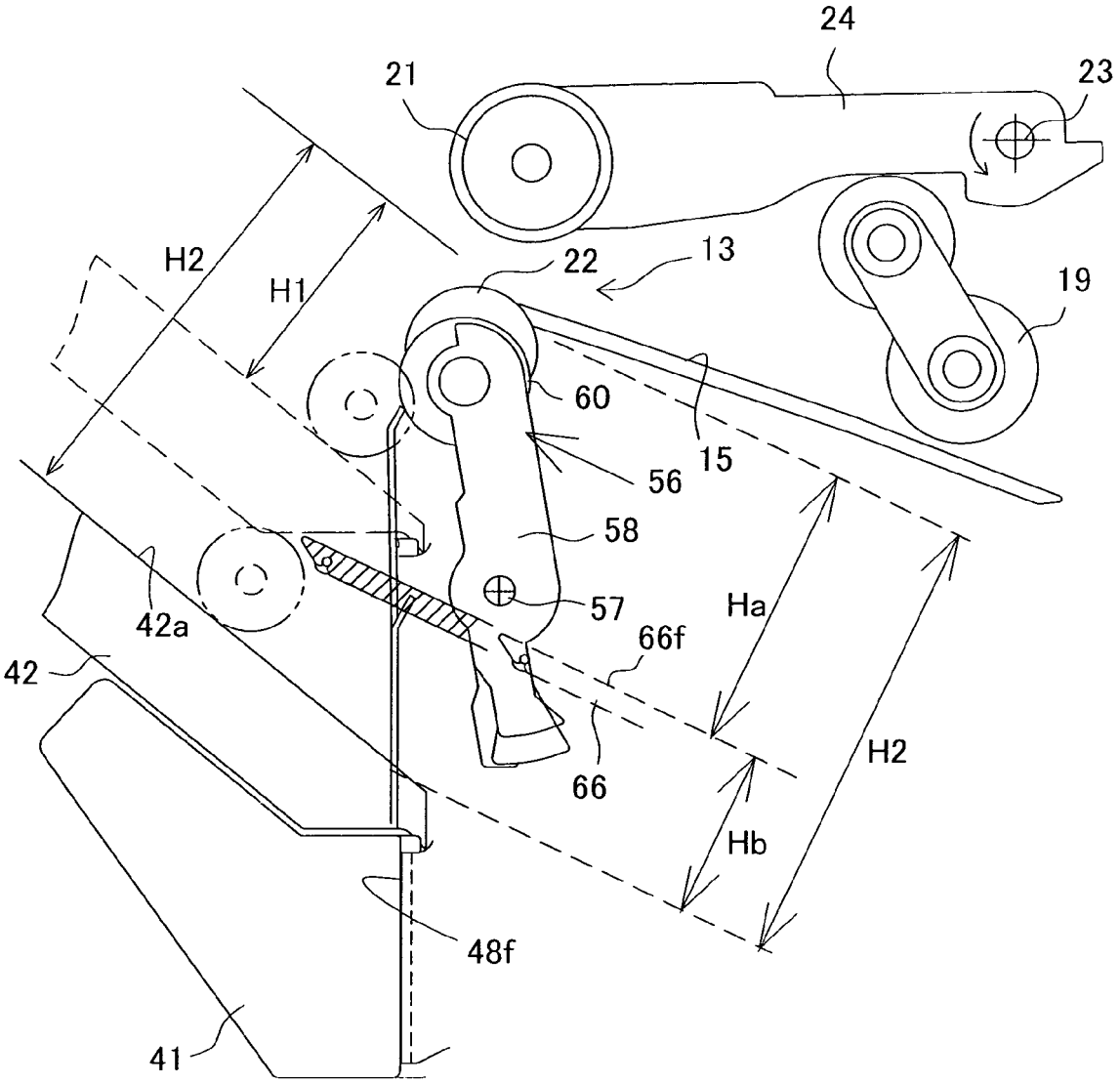
FIG. 7 is a state explanatory view of a sheet holding unit which detects a height position of a stack tray of the post-processing apparatus in FIG. 2.

When the first sensor LSe1 is OFF, the second sensor LSe2 is OFF, and the third sensor LSe3 is OFF, the sheet holding unit 56 is located at the waiting position (home position as illustrated with solid line in FIG. 7). The sensors and flags are arranged at angle positions to satisfy the above. When the first sensor LSe1 is OFF and the second sensor LSe2 is ON, it is indicated that the sheet holding unit 56 is located at a position being higher than the first storing height. When the first sensor LSe1 is ON and the second sensor LSe2 is OFF, it is indicated that the sheet holding unit 56 is located at a position being lower than the first storing height.

Similarly, when the first sensor LSe1 is ON and the third sensor LSe3 is ON, it is indicated that the sheet holding unit 56 is located at an appropriate position of the second storing height (second level). When the first sensor LSe1 is ON and the third sensor LSe3 is OFF, it is indicated that the sheet holding unit 56 is located at a position being higher than the second storing height. When the first sensor LSe1 is OFF and the third sensor LSe3 is ON, it is indicated that the sheet holding unit 56 is located at a position being lower than the second storing height.

Here, when the sheet placement tray 42 is set at the first storing height position H1, sheets are stored at the sheet placement tray 42 one by one in the abovementioned first sheet discharge mode. Here, the pressurizing means (press lever 61) is maintained at a non-operating position. When the sheet placement tray 42 is set at the second storing height position H2, sheet bundles are stored at the sheet placement tray 42 from the processing tray 15 in a later-mentioned second conveyance mode. Here, the pressurizing means (press lever 61) is maintained at a pressurizing position. Further, the frictional rotor 60 is rotated so that a tailing end of a sheet stored on the upmost sheet face from the sheet discharging port 13 in the later-mentioned first sheet discharge mode is abutted to the tailing end regulating face 48*f*. At that time, the frictional rotor 60 presses a sheet face with the low pressurization force (own weight of the roller and the swing arm). In a second sheet discharge mode to discharge a sheet bundle from the processing tray 15, sheets are pressed (with the high pressurization force) simply in a state that a rotation force is not applied to the frictional rotor 60.

[Sheet Tailing End Supporting Mechanism]

As described above, the illustrated post-processing apparatus B provides the first sheet discharge mode and the second sheet discharge mode. In the first sheet discharge mode, the height difference between the sheet discharging port 13 and the upmost sheet face on the sheet placement tray 42 is set to the first storing height position H1. In the second sheet discharge mode, the height difference H2 between the sheet discharging port 13 and the sheet placement tray 42 is set to the second storing height position H2 (second level Hv2). The first height difference is set small and the second height difference is set large, that is, the height difference H1 is smaller than the height difference H2.

The sheet tailing end supporting mechanism 65 is arranged at the middle position to support a tailing end of a sheet bundle when a sheet bundle is stored as being dropped onto the upmost sheet face on the sheet placement tray 42 from the discharging port 13 in the second sheet discharge mode under such sheet discharge conditions.

Figure 14:
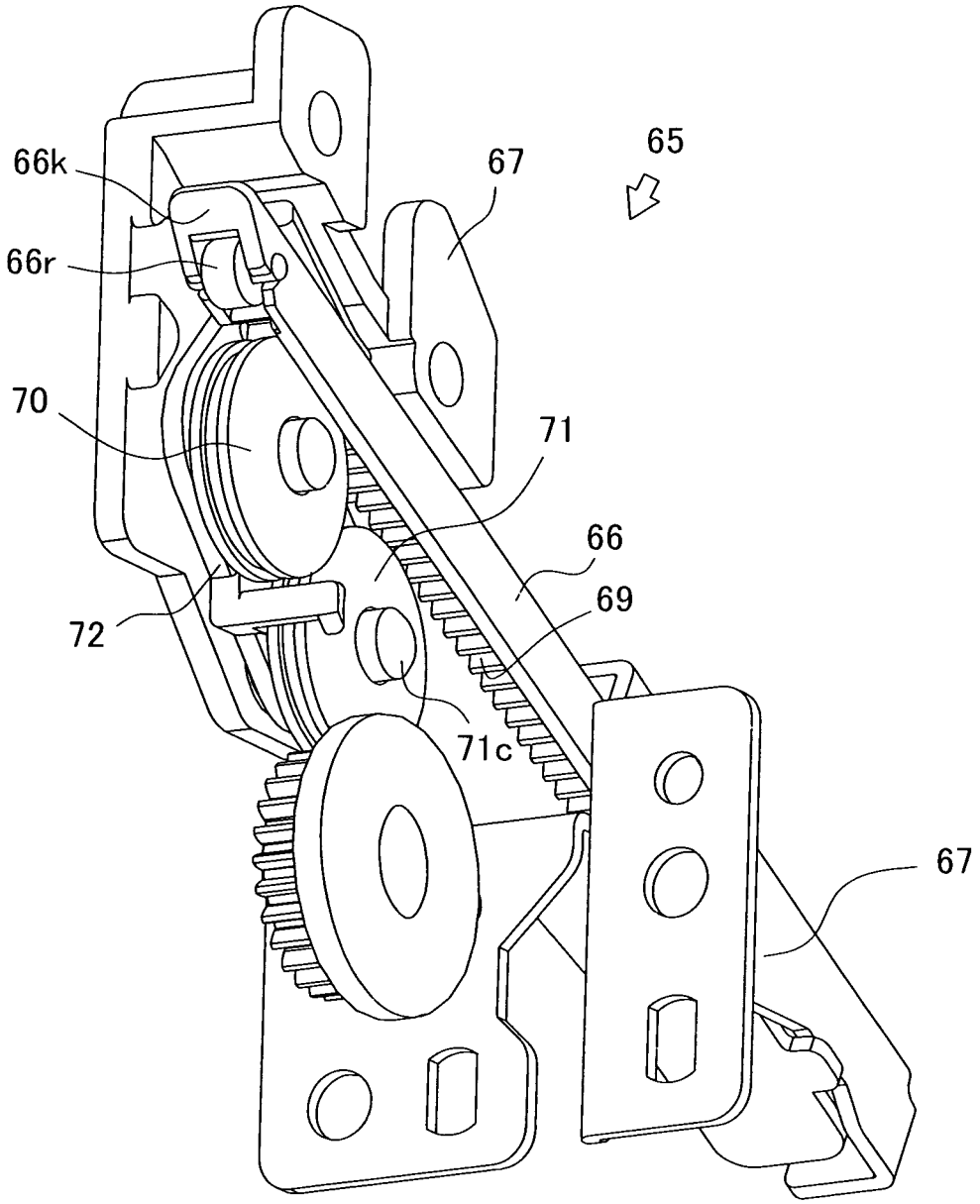
FIG. 14 is an explanatory view of a perspective structure of a tailing end supporting member of the stack tray.

FIG. 14 is an explanatory perspective view of the sheet tailing end supporting mechanism 65. A pair of the tailing end supporting mechanisms 65 each having the illustrated structure are arranged laterally distanced in the sheet width direction. The positional relation thereof is illustrated in FIG. 7. The tailing end supporting mechanisms 65 are arranged at both sides of the abovementioned sheet holding unit 56. The tailing end supporting mechanism 65 at one side will be described with reference to FIG. 14. The mechanism at the other side is the same.

The tailing end supporting mechanism 65 includes the tailing end supporting member 66 which has the supporting face 66*f*, a slide guide 67 (hereinafter, also called a holder member) which supports the tailing end supporting member 66 to be movable between the waiting position Wp retracting from the side above the sheet placement tray 42 and the operating position Ap above the sheet placement tray 42, and lever shifting means 68 which moves the tailing end supporting member between the waiting position Wp and the operating position Ap.

The tailing end supporting member 66 temporarily supports a tailing end of a sheet bundle which drops through the discharging port 13. Hence, the tailing end supporting member 66 includes the supporting face 66*f* (also called the support face) which receives and supports a tailing end of a sheet bundle dropping from the upper side is arranged at a middle position between the discharging port 13 and the upmost sheet face. The tailing end supporting member 66 is arranged at a height position set between the discharging port 13 and the upmost sheet face (having a distance Ha against the discharging port 13 and a distance Hb against the upmost sheet face illustrated in FIG. 7). The tailing end supporting member 66 is supported by being fitted to the slide guide 67 as being movable between the operating position Ap (illustrated by a solid line in FIG. 7) above the sheet placement tray 42 and the waiting position Wp (illustrated by a broken line in FIG. 7) retracting outside the sheet placement tray 42.

The slide guide 67 is fixed to the apparatus frame F. When a sheet bundle is discharged through the discharging port 13, the slide guide 67 moves from the waiting position Wp to the operating position Ap in accordance with discharging timing thereof, supports a tailing end of the sheet bundle dropping onto the sheet placement face above the sheet placement face, and moves rearward after the supporting from the operating position to the waiting position. Accordingly, the sheet tailing end supported on the supporting face 66*f* is stored on the stacked sheet owing to the rearward moving to the waiting position.

The illustrated tailing end supporting member 66 is structured with a plate-shaped lever member having a predetermined width in the sheet width direction and is configured to proceed to and retract from the side above the sheet placement tray 42 through the fence plate 48 of the apparatus frame F. As illustrated in FIG. 7, the tailing end supporting member 66 is arranged at the middle position of the height difference H2 between the discharging port 13 and the upmost sheet face while the height Ha in FIG. 7 is set to a distance being larger than the maximum allowable sheet bundle thickness Hmax (Ha>Hmax). Meanwhile, the distance Hb between the supporting face 66*f* and the upmost sheet face is set smaller than the distance Ha between the discharging port 13 and the tailing end supporting member 66. Further, when the distance Hb between the supporting face 66*f* and the upmost sheet face is set to a distance being smaller than the maximum allowable sheet bundle thickness Hmax, the sheet tailing end supported by the supporting face 66*f* can make a soft landing onto the upmost on the sheet placement tray 42.

Following is the reason why height setting of the tailing end supporting member 66 is performed as described above. If the supporting face does not exist, a sheet bundle drops through the discharging port 13 with the height difference H2 (=Ha+Hb). Owing to the impact at that time, the dropping sheet bundle and sheet bundles stacked on the sheet placement tray 42 are disturbed in posture to cause positional shifting, collapsing, and the like. In contrast, when the supporting face 66*f* exists at the middle position (Ha) of the height difference H2, first, the sheet bundle drops onto the supporting face 66*f* through the discharging port 13, and subsequently, drops onto the stacked sheet face with the height difference Hb. Accordingly, dropping impact is eased and the dropping sheet bundle and the stacked sheet bundles are prevented from being collapsed.

In the illustrated apparatus, the tailing end supporting member 66 has a configuration having features of (i) being structured with the plate-shaped lever member, (ii) differentiating angles of proceeding to and retracting from the sheet placement tray 42, (iii) forming the top end thereof as an inclined face to follow a sheet face shape of a sheet bundle on the sheet placement tray 42, and (iv) arranging an idling roller at the inclined face. Each configuration thereof will be described.

Figure 15:
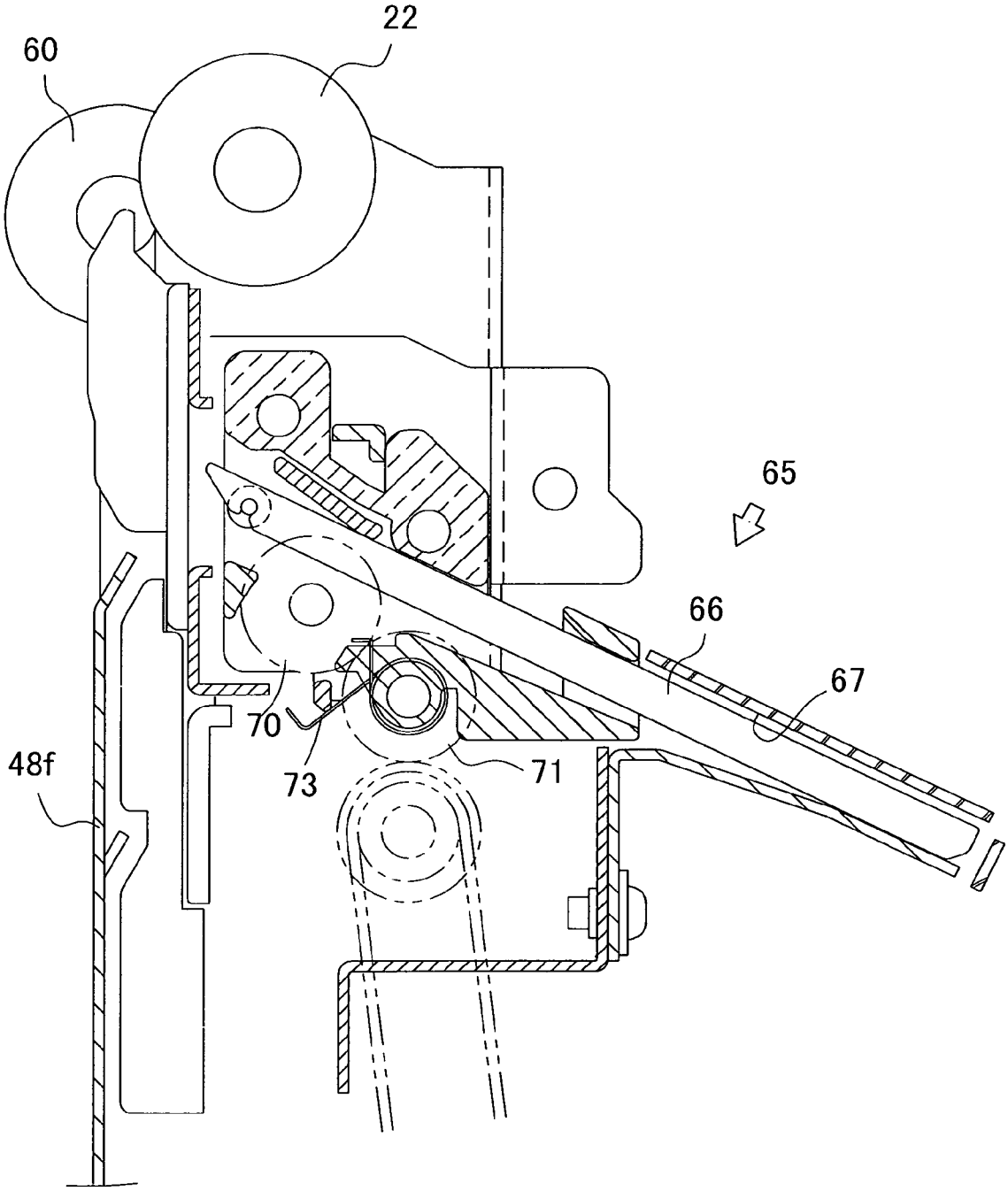
FIG. 15 is an explanatory view of a mechanism which causes the tailing end supporting member to proceed to and retract from the tray.
Figure 16A:
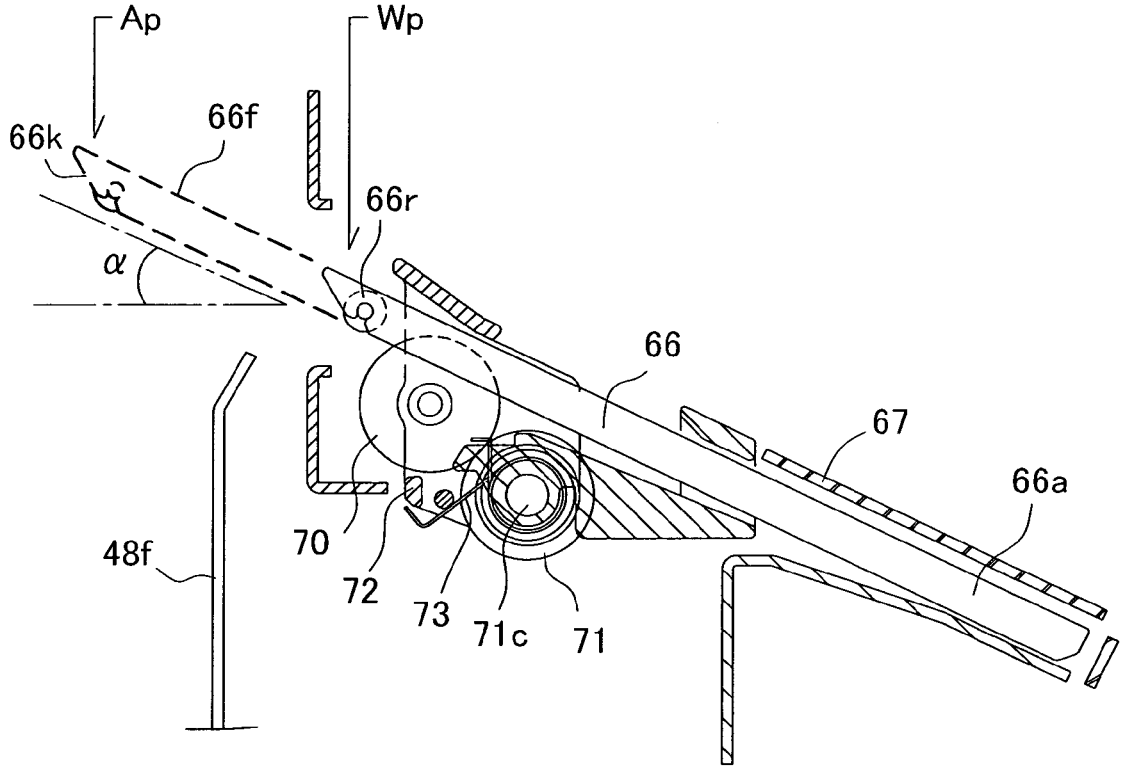
Figure 16B:
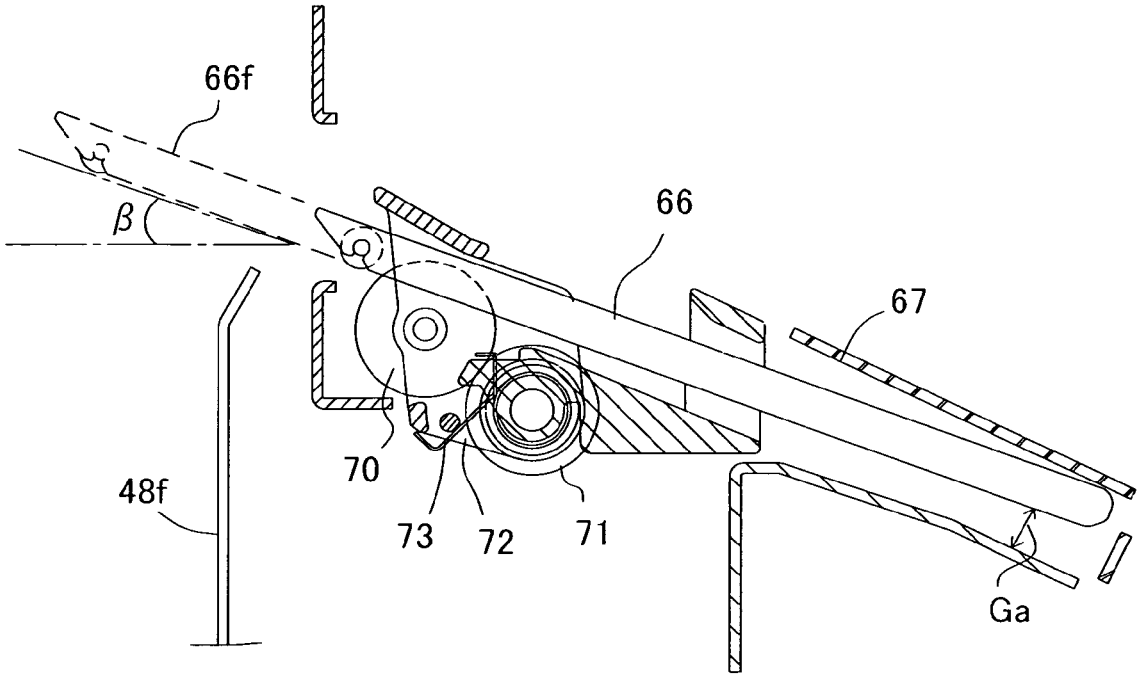
Figure 17:
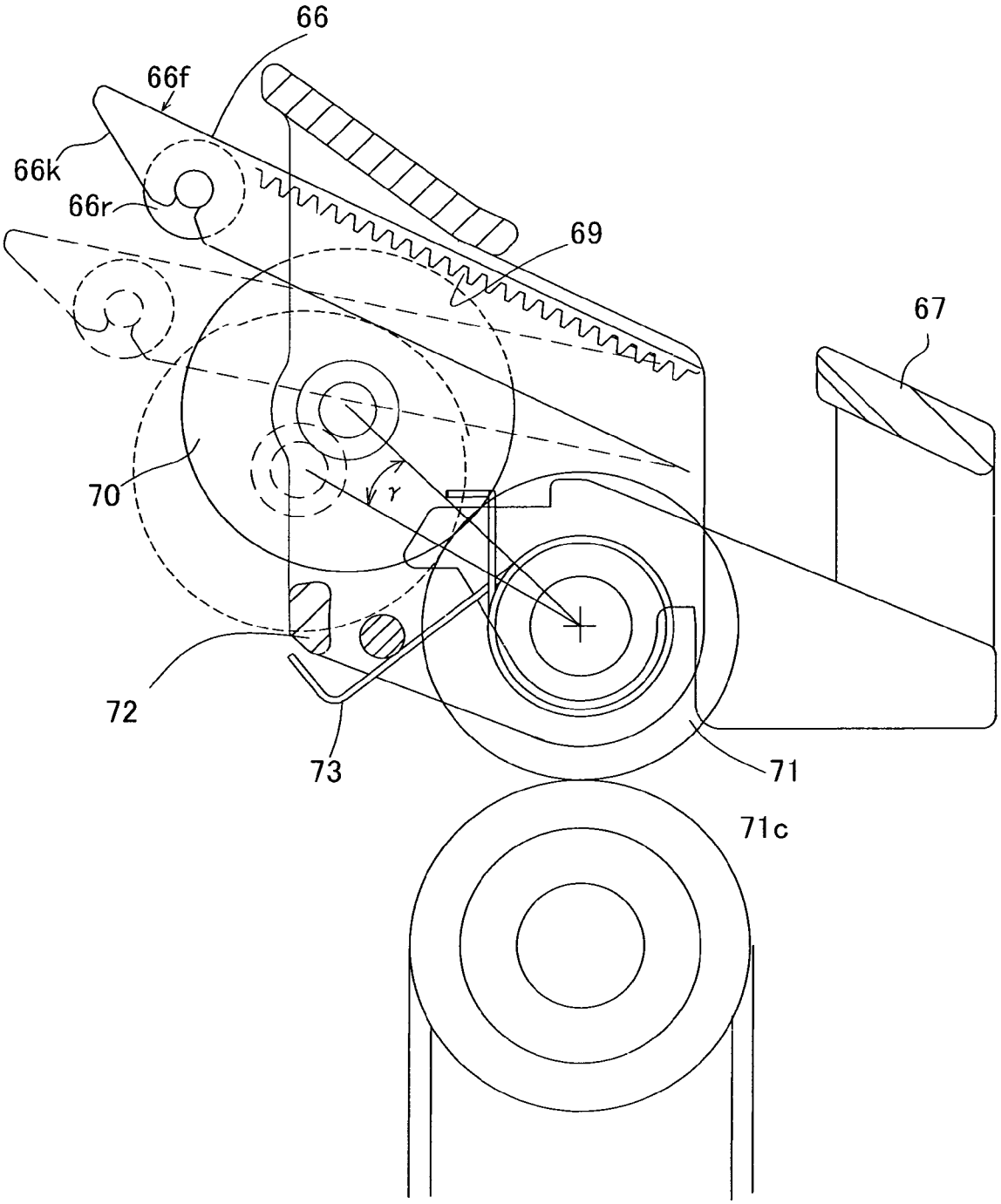
FIG. 17 is an explanatory view illustrating a planetary gear mechanism which varies an angle of the tailing end supporting member.

The tailing end supporting mechanism 65 is illustrated in FIGS. 14 to 17; while FIG. 14 is an explanatory perspective view, FIG. 15 is a plane view in an assembled state, FIGS. 16A and 16B illustrate operation states of the tailing end supporting member, and FIG. 17 illustrates a state of varying an angle thereof. As illustrated in FIG. 14, the tailing end supporting member 66 is structured with the plate-shaped lever member and the lever member is supported by the slide guide 67 (holder member) which is fixed to the apparatus frame F. As illustrated in FIGS. 16A and 16B, the lever member 66 is moved from the waiting position illustrated by a solid line to the operating position illustrated by a broken line along the slide guide 67. A later-mentioned rack 69 is arranged at the lever member 66 and a pinion 70 which is engaged therewith is connected to a lever operating motor LM.

The supporting face 66*f* (support face) is formed at a plate-shaped front face of the lever member 66 and an inclined face 66*k* is formed at a back face thereof. Then, a base end portion 66*a* of the lever member 66 is slidably supported as being fitted to the slide guide 67 which is formed at the apparatus frame F so as to perform reciprocation motion at a predetermined stroke between the operating position AP and the waiting position Wp.

To allow the lever member 66 to perform swing motion in addition to the linear motion at the predetermined stroke, a gap Ga is formed at the illustrated slide guide 67. The gap Ga is for varying an angular posture of the lever member 66 between a state illustrated by a solid line in FIG. 17 (a first angular posture, an upward angular posture) and a state illustrated by a broken line (a friction posture, a downward posture). Accordingly, when the gap Ga between the slide guide 67 and the lever member 66 is set large, angle difference between a first angle $\alpha$ and a second angle $\beta$ becomes large. On the contrary, when the gap Ga is set small, the angle difference becomes small.

The rack 69 is formed at the back face side (a lower face side facing to a stacked sheet face) of the lever member 66. A driving pinion 71 which is connected to the lever operating motor LM is gear-connected to the rack 69. The lever operating motor LM is mounted on the apparatus frame F and is connected to the driving pinion 71 attached to the apparatus frame F via a reduction gear. The driving pinion 71 is connected to a gear holder 72 so that a transmitting pinion 70 performs planetary motion within a predetermined angle range y (see FIG. 17) as a planet gear. That is, as illustrated in FIG. 17, the gear holder 72 is rotatably supported by a rotary spindle 71*c* of the driving pinion 71 and the transmitting pinion 70 is rotatably axis-supported by the gear holder 72.

Accordingly, the transmitting pinion 70 receives rotation from the driving pinion 71 and transmits the rotation to the rack 69 of the lever member 66. Then, the transmitting pinion 70 rolls on the outer circumference of the driving pinion 71 as the planet gear. An urging spring 73 which urges the lever member 66 to the first angle posture (state in FIG. 16A) is arranged at the gear holder 72. One end of the urging spring 73 is engaged with the gear holder 72 and the other end thereof is engaged with the apparatus frame F.

The urging spring 73 continuously urges the support member 66 to the first angle posture. The urging spring 73 is set to have spring pressure so that the tailing end supporting member 66 is moved from the first angle posture to the second angle posture owing to sheet bundle weight. For example, the urging spring 73 is designed so that the spring pressure thereof is overcome by sheet weight applying at the sheet bundle tailing end with an average sheet size, average basis weight, and average bundle thickness.

The top end of the lever member 66 is formed into a shape to follow a face of a sheet stacked on the sheet placement tray 42. As FIG. 17 illustrates an enlarged state thereof, the inclined face at the lever top end is approximately in parallel to a sheet face angle of the upmost sheet tailing end. That is, the inclined face 66*k* having a tapered shape is formed at the top end of the lever member 66. When the lever member 66 is in the first angle posture, the inclination angle is set to the inclination angle α (FIG. 16A) rising upward against the upmost sheet stacked on the sheet placement tray 42. The above state is illustrated in FIG. 16A. According to the above, when the lever member 66 enters the sheet placement tray 42 in the first angle posture, the upmost sheet is guided to an idling roller 66*r* along the inclined face 66*k* of the lever member 66 without being pushed out in the lever proceeding direction even if the upmost sheet is curled.

When the lever member 66 retracts from the sheet placement tray 42 in the second angle posture, the lever member 66 performs a function to draw the upmost sheet in the retracting direction owing to that the lever member 66 retracts at the inclination angle β (FIG. 16B) which is approximately the same as the angle of the sheet shape of the upmost stacked sheet. According to the inclination angle β, the height difference between the sheet bundle and the upmost sheet can be set minimum. When the upmost sheet is moved in the lever retracting direction during retracting of the lever member 66, the sheet is regulated in position as the tailing end thereof being abutted to the tailing end regulating face 48*f* (fence plate).

Here, it is also possible to form the plate-shaped lever member 66 to have the same width as that of a sheet bundle in the width direction. However, when contact area with the sheet bundle increases, loads for the lever member 66 increase to proceed to and retract from the side above the sheet placement tray 42. Here, the function to maintain a tailing end of a sheet bundle above the upmost sheet face with engagement is less influenced by the width of the lever member 66.

That is, the width shape of the lever member 66 is determined in consideration of a friction load during proceeding to and retracting from the side above the sheet placement tray 42, the maintaining function to support a sheet bundle tailing end, and an efficiency in space. The plate-shaped lever members 66 are arranged at two positions laterally in the vicinity of a staple binding position as being distanced in the sheet bundle width direction. Owing to supporting the vicinity of the staple binding position, even when swelling occurs at the staple binding position, contact between a sheet bundle and the staple binding position can be prevented and occurrence of scratches can be prevented. However, it is also possible to support a position being apart from the stapling portion in the sheet width direction. In the illustrated case, the sheet holding unit 56 (frictional rotor 60) is arranged at the sheet center and a right-left pair of the lever members 66 are arranged at both sides with the same structure. Not limited to the plate-shaped member, the tailing end supporting member 66 may adopt a plate member having an appropriate shape to support a tailing end of a sheet bundle. Further, it is also possible to adopt arrangement at three or more positions along a sheet rear end edge.

[Operation of Tailing End Supporting Member]

Figure 18A:
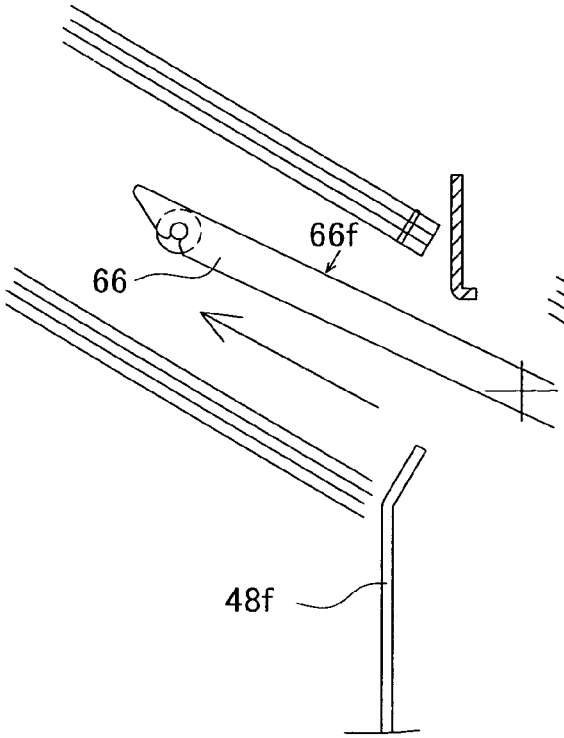

Operation of the tailing end supporting member 66 will be described with reference to FIGS. 18A to 18D. FIG. 18A illustrates a state that the tailing end supporting member 66 enters the sheet placement tray 42 and a sheet bundle drops from the discharging port 13 at the upper side. In this state, the tailing end supporting member 66 proceeds to the side above the sheet placement tray 42 at the first angle α (upward posture). Here, even when the upmost sheet on the sheet placement tray 42 warps with upward curling, the supporting member 66 proceeds to the side above the sheet placement tray 42 without collapsing sheet posture while the inclined face 66*k* introduces the curled sheet in the direction toward the idling roller 66*r*.

Figure 18B:
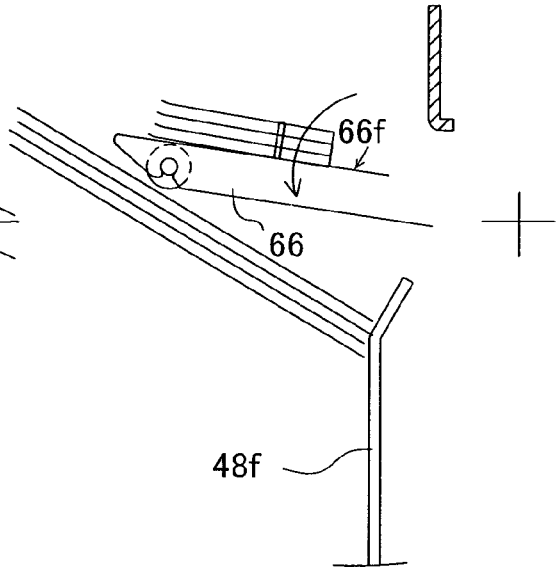
Figure 18C:
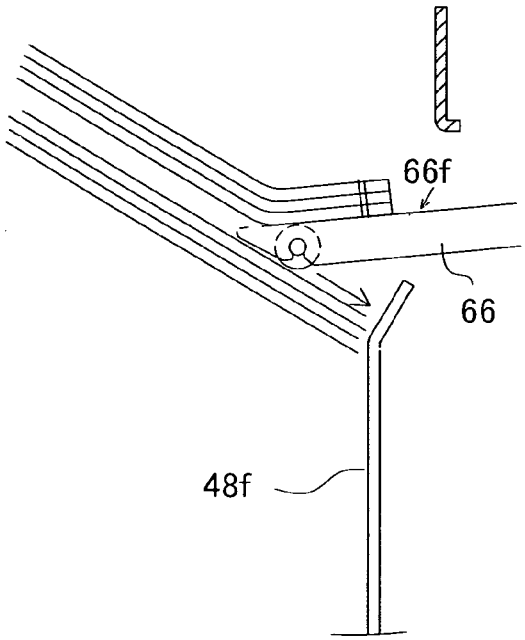

FIG. 18B illustrates a state that a sheet bundle drops on the supporting face 66*f* of the tailing end supporting member 66. The tailing end supporting member 66 is swung onto the upmost sheet with weight of the sheet bundle against the urging spring 73. At that time, the supporting face 66*f* is in the second angle posture at the angle β. FIG. 18C illustrates a state that the tailing end supporting member 66 retracts from the operating position to the waiting position in the second angle posture. At that time, the inclined face 66*k* and the idling roller 66*r* at the top end of the tailing end supporting member 66 draw the upmost sheet stacked on the sheet placement tray 42 to be abutted to the tailing end regulating face 48*f*.

Figure 18D:
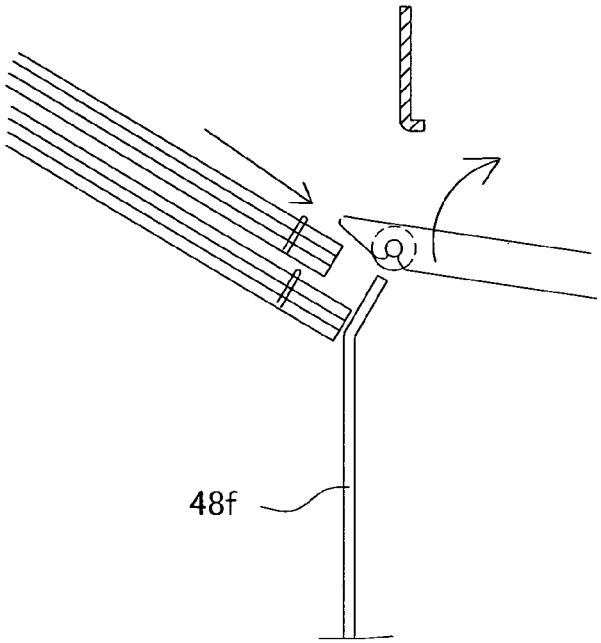

FIG. 18D illustrates a state that the tailing end supporting member 66 retracts from the tailing end regulating face 48*f* to the waiting position. At that time, the tailing end supporting member 66 returns from the second angle posture to the first angle posture. The reciprocating motion of the tailing end supporting member 66 between the waiting position and the operating position is performed with forward-reverse rotation of the lever operating motor LM.

[Control Configuration]

Figure 19:
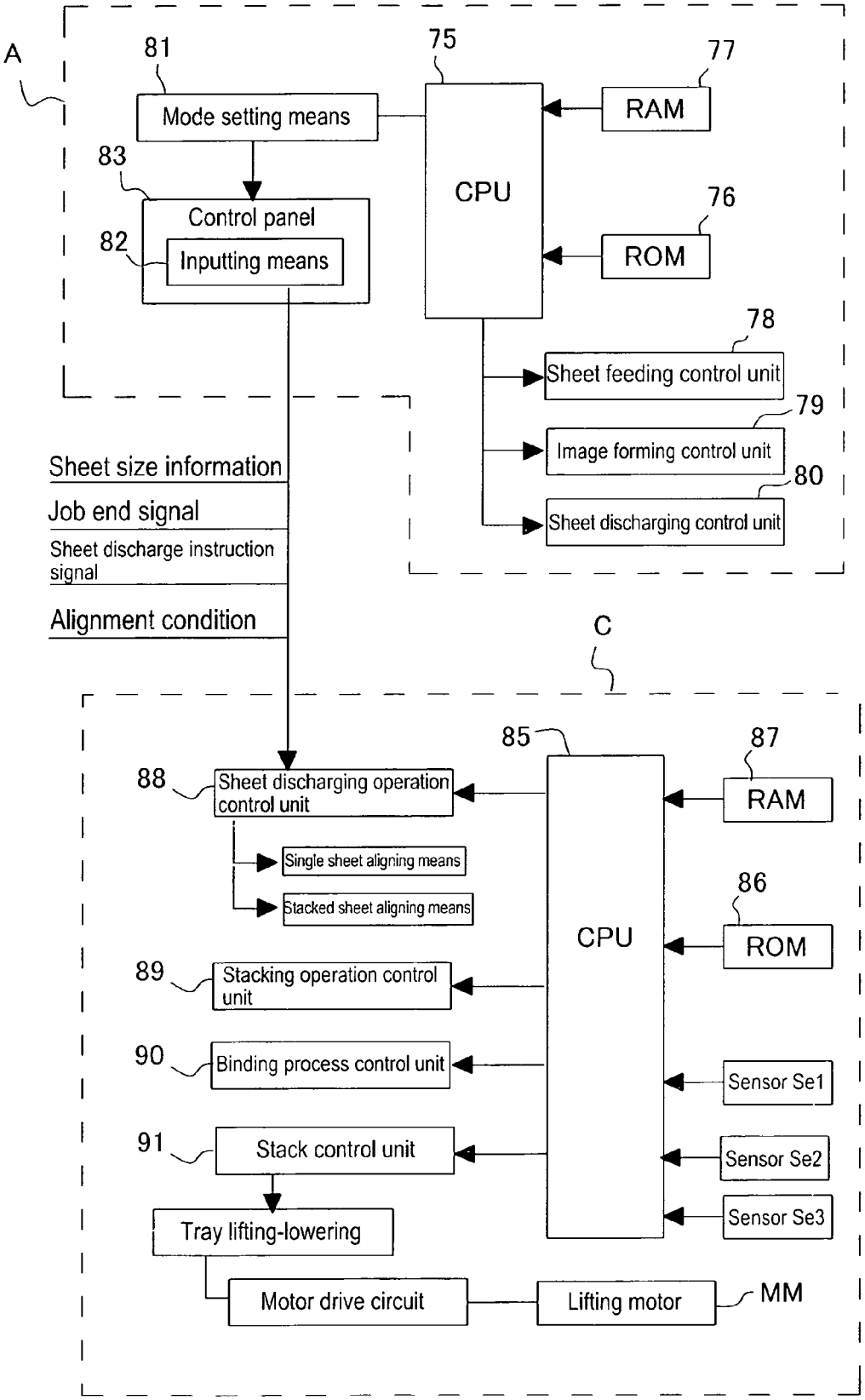
FIG. 19 is an explanatory view of a control configuration of an image forming system in FIG. 1.

A control configuration of the image forming system illustrated in FIG. 1 will be described with reference to FIG. 19. A control CPU 75 is arranged in the image forming unit A. The control CPU 75 is connected with a ROM 76 which stores an operational program and a RAM 77 which stores control data. The control CPU 75 is provided with a sheet feeding control unit 78, an image forming control unit 79, and a sheet discharging control unit 80. Further, the control CPU 75 is connected with mode setting means 81 and a control panel 83 which includes inputting means 82.

Further, the control CPU 75 is configured to perform selection among a print-out mode, a jog mode, and a post-process mode. In the print-out mode, an image-formed sheet is stored at the stack tray 40 without performing a finishing process thereon. In jog mode, image-formed sheets are offset-stored at the stack tray 40 to be capable of being collated and sorted. In the post-process mode, image-formed sheets are collated and stacked, and then, stored at the stack tray 40 after a binding process is performed thereon.

A post-process control CPU 85 is arranged in the post-processing unit B and is connected with a ROM 86 which stores a control program and a RAM 87 which stores control data. The post-process control CPU 85 receives, from the control unit of the image forming unit A, sheet size information, a sheet discharge instruction signal, a mode setting command being the post-process mode and the print-out mode.

The post-process control CPU 85 is provided with a sheet discharging operation control unit 88, a stacking operation control unit 89 for collating and stacking sheets on the processing tray 15, a binding process control unit 90, and a stack control unit 91.

[Description of Operation]

The control CPU 75 of the image forming unit A performs a following image forming operation in accordance with an image forming program stored in the ROM 76. Similarly, the control CPU 85 of the post-processing unit B performs a following post-processing operation in accordance with a post-process program stored in the ROM 86.

[Image Forming Operation]

When a single print mode is selected, the control CPU 75 feeds out a sheet of a set size from a sheet feeding portion 2 and conveys the sheet to the sheet feeding path 3. Along with the above, the control CPU 75 forms an image at the image forming portion 4 in accordance with specific image data. The image data is stored in a data storing portion (not illustrated) or is transmitted from an external device which is connected to the image forming unit A.

When a duplex print mode is selected, after an image is formed on a front face of a sheet by performing the abovementioned operation, the control CPU 75 face-reverses the sheet in the duplex path 7 which is arranged continuously to the sheet discharging path, feeds the sheet again to the image forming portion 4, and then, feeds the sheet to the sheet discharging path 5 after an image is formed on a back face of the sheet.

Next, the control CPU 85 of the post-processing apparatus B introduces the sheet fed to the body discharging port 6 to the introducing port 12 of the sheet conveying path 11. At that time, the control CPU 85 receives a sheet discharge instruction signal from the image forming apparatus A and rotates the conveying roller 14 on the conveying path in the sheet discharging direction.

The control means (post-process control CPU) 85 performs following sheet discharging operations in accordance with a program stored in the ROM 86 based on the post-process mode which is set at the image forming unit A. The illustrated control means 85 includes the first sheet discharge mode (print-out sheet discharge mode) and the second sheet discharge mode (post-process sheet discharge mode).

In the first sheet discharge mode, the sheet fed to the introducing port 12 is stored as being discharged to the stack tray 40 from the sheet conveying path 11. That is, the sheet fed from the sheet conveying path 11 is stored as being dropped through the sheet discharging port 13 directly to the stack tray 40 without being conveyed to the processing tray 15 by the reversing rollers 21, 22. In the first discharge mode, the straight sheet discharging operation and the jog sheet discharging operation are selectively performed.

According to the jog discharging operation, the sheet fed to the introducing port 12 is stored from the sheet conveying path 11 at the stack tray 40 in a state of being sorted and collated. During performing in this mode, the sheet placement tray 42 is moved by the cam member 50 integrally with the fence plate 48 by a predetermined amount in the sheet width direction as operating the abovementioned jog shifting motor GM. According to the above, a series of sheets are stacked on the sheet placement tray 42 as being collated in the width direction. Then, upon receiving a job end signal from the image forming apparatus A, the control means 85 moves the sheet placement tray 42 to be returned to an initial position. Next, upon receiving an image forming signal and a sheet discharge instruction signal for a subsequent sheet, the control means 85 moves the sheet placement tray 42 by a predetermined amount in a direction opposite to the above.

In the second sheet discharge mode, the sheet fed to the introducing port 12 is stacked on the processing tray 15 from the sheet conveying path 11 and stored at the stack tray 40 after a binding process is performed. The sheet discharging operation in this mode is the same as described above.

[Sheet Discharging Operation]

Figure 20A:
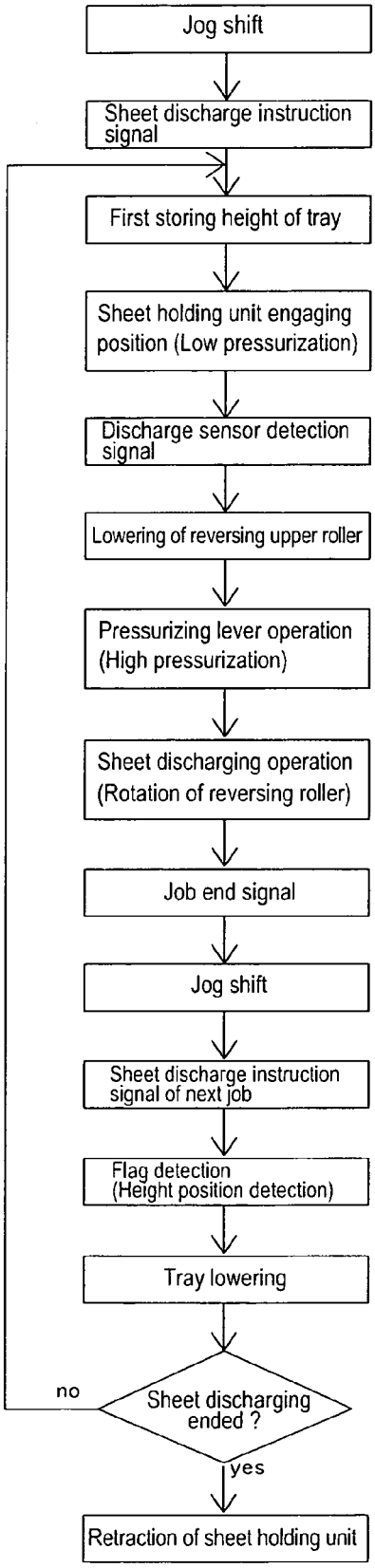

FIG. 20A illustrates flow of the jog sheet discharging operation. Here, the sheet holding unit 56 rakes a sheet dropping through the sheet discharging port 13 at the upper side to be aligned to the tailing end regulating face 48*f* by the frictional rotor 19 in a state of pressing as engaging on the upmost sheet on the sheet placement tray 42 (first embodiment). Alternatively, a sheet is stored as being dropped through the sheet discharging port 13 in a state that the sheet holding unit 56 is on standby at the waiting position outside the sheet placement tray 42, and then, a height level is detected at the same time when the sheet holding unit 56 presses the sheets as being engaged onto the upmost sheet at an interval before a subsequent sheet is introduced (second embodiment). Either of the abovementioned operations is selectively performed.

FIG. 20A illustrates sheet holding control to store a sheet as dropping the sheet through the sheet discharging port 13 onto the frictional rotor 60 of the sheet holding unit 56 in a state that the sheet holding unit 56 is engaged onto the upmost sheet on the sheet placement tray 42.

When the jog sheet discharging operation is set at the image forming apparatus A, the control means 85 of the post-processing apparatus B moves the sheet placement tray 42 with offsetting to a previously-set jog position. Here, the sheet placement tray 42 and the fence plate 48 are moved in the sheet width direction by the cam member 50 as rotating the jog shifting motor GM by a predetermined amount.

Next, the control means 85 moves the sheet placement tray 42 to the first storing height position H1. The height of the sheet placement tray 42 is controlled with a rotation amount of the winding motor MM while detecting a height position of the sheet holding unit 56 with the first to third sensors Lse1, Lse2, and Lse3.

After performing height position setting of sheet placement tray 42, the control means 85 moves the sheet holding unit 56 from the waiting position at the outside of the sheet placement tray 42 to the operating position at the inside thereof. This operation is performed with the abovementioned rotational angle adjustment of the sheet holding motor KM and position detection of the flags fr1, fr2, and fr3 by the first to third sensors Lse1, Lse2, and Lse3. Here, when the sheet holding unit 56 is set at the first storing height position H1, a pressurization force of the frictional rotor 60 to press a stacked sheet face illustrated in FIG. 13B is set to be smaller than a pressurization force of FIG. 13C as being set at the second storing height position H2. That is, FIG. 13B illustrates a state that the pressurizing spring 62 is not operating and FIG. 13C illustrates a state that the pressurizing spring 62 is operating.

Next, when the discharging sensor Se2 detects a sheet leading end, the reversing roller 20 is moved from the waiting position Wp to the operating position Ap after a predetermined amount of time. At that time, the lifting-lowering lever 30 is shifted to a pressurizing position by the lifting-lowering motor SM. Then, at the reversing roller 20, the upper roller 21 and the lower roller 22 are pressure-contacted with the high pressurization force. Here, the large-diameter roller 21*a* and the small-diameter roller 21*b* are pressure-contacted to the lower roller 22. When the upper roller 21 is rotated in the sheet discharging direction in the above state, a sheet is discharged through the sheet discharging port 13 toward the sheet placement tray 42.

Next, when the control means 85 receives a job end signal from the image forming apparatus A, the jog shifting motor GM is rotated in the direction opposite to the above. Then, the sheet placement tray 42 is returned to the predetermined initial position. Upon receiving a sheet discharge instruction signal for the next job, height of the sheet placement tray 42 is detected by detecting flag positions of the sheet holding unit 56 with the first to third sensors LSe1, LSe2, and LSe3. Here, upon receiving the jog end signal, the sheet holding unit 56 is returned from the detecting position to the waiting position.

A subsequent sheet is stored in a state of offsetting against a preceding sheet by a predetermined amount in a direction perpendicular to the sheet discharging direction to be sorted for each bundle. During such a sheet discharging operation, there is a case that sheets on the sheet placement tray 42 are carelessly removed by an operator.

Figure 20B:
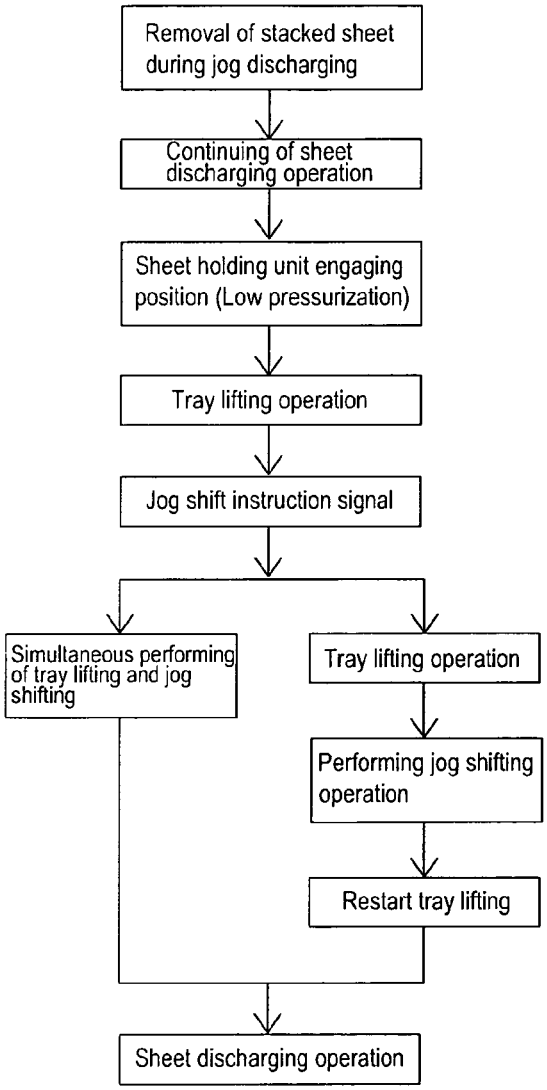

FIG. 20B illustrates an operation when sheets on the sheet placement tray 42 are carelessly removed. Regardless of careless sheet removing, the control means 85 continues the sheet discharging operation. Then, height of the sheet placement tray 42 is detected at predetermined timing. When a sheet face on the sheet placement tray 42 is determined as being lower than a predetermined height position with the detecting operation, the control means 85 drives the winding motor MM to move the sheet placement tray 42 to the predetermined height position.

When a jog shift instruction signal is received from the image forming apparatus A during lifting of the sheet placement tray 42, the control means 85 causes the sheet placement tray 42 to move to a predetermined offset position after the lifting operation of the sheet placement tray 42 is stopped or in parallel to the lifting operation thereof. In the case that the lifting operation is stopped, the control means 85 restarts the lifting operation of the sheet placement tray 42 after moving the sheet placement tray 42 to the predetermined offset position.

Figure 21:
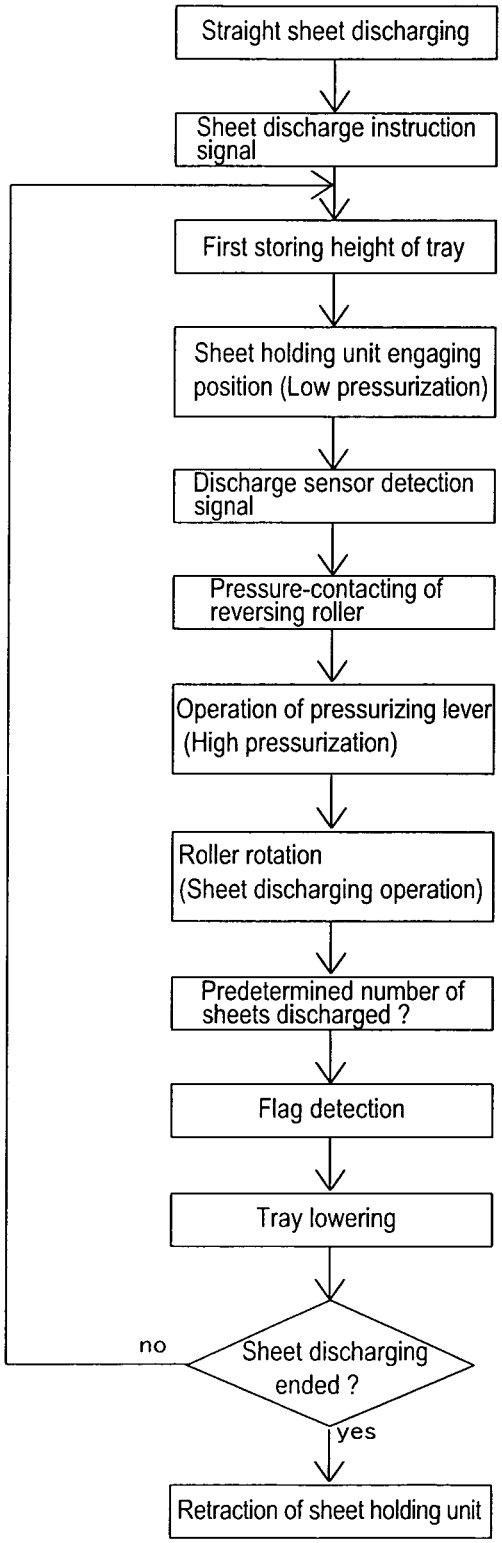
FIG. 21 is an explanatory view of operation flow of a straight sheet discharging operation to discharge sheets on the stack tray without sorting in the sheet discharge mode in which a sheet fed to a sheet discharging path is stored at the stack tray one by one.

Next, an operation when the straight sheet discharging operation is selected in a post-process mode selection step of the image forming apparatus A will be described with reference to FIG. 21. When mode selection is performed as the straight sheet discharging operation, the operation is performed in accordance with FIG. 21. When the sheet discharge instruction signal is received from the image forming apparatus A, the control means 85 of the post-processing apparatus B moves the sheet face of the upmost sheet on the sheet placement tray 42 to the first storing height position H1. After the tray lifting operation, the control means 85 moves the sheet holding unit 56 from the waiting state to the low pressurization state. Then, the reversing roller 20 is moved from a separated state to a pressure-contacted state with reference to a signal of a sheet leading end detected by the discharge sensor Set. As the operation, the upper roller 21 is lowered toward the lower roller 22 and both the rollers are pressure-contacted at timing when the sheet leading end arrives at the roller position. Here, the pressure-contact force of the rollers is set at the high pressurization force. The sheet fed to the sheet discharging port 13 is nipped between the upper roller 21 and the lower roller 22 and is discharged toward the sheet placement tray 42 at the downstream side.

Further, the control means 85 rotates the frictional rotor 60 of the sheet holding unit 56 in a predetermined direction (counterclockwise direction in FIG. 2). With the above operation, the sheet is conveyed toward the stack tray 40, and then, drops onto the sheet placement tray 42 after a tailing end thereof passes through the sheet discharging port 13. The leading end of the sheet is supported onto the upmost sheet stacked on the sheet placement tray 42 and the tailing end thereof drops onto the frictional rotor 60. At that time, since the frictional rotor 60 is rotated in the counterclockwise direction in FIG. 2, the tailing end side of the sheet is raked onto stacked sheets along the circumferential face of the frictional rotor 60 and is stacked thereon. Then, the tailing end edge of the sheet is aligned as being abutted to the tailing end regulating face 48*f*.

When sheets corresponding to the previously-set discharging times are stored on the sheet placement tray 42 by repeating the above operations, the control means 85 detects the height position of the sheet holding unit 56. Then, the sheet placement tray 42 is lowered by a predetermined amount in accordance with the detected height position. When a job end signal is received from the image forming apparatus A after the above operations, the sheet holding unit 56 retracts to the waiting position and the flow is ended.

[Staple Binding]

Figure 22:
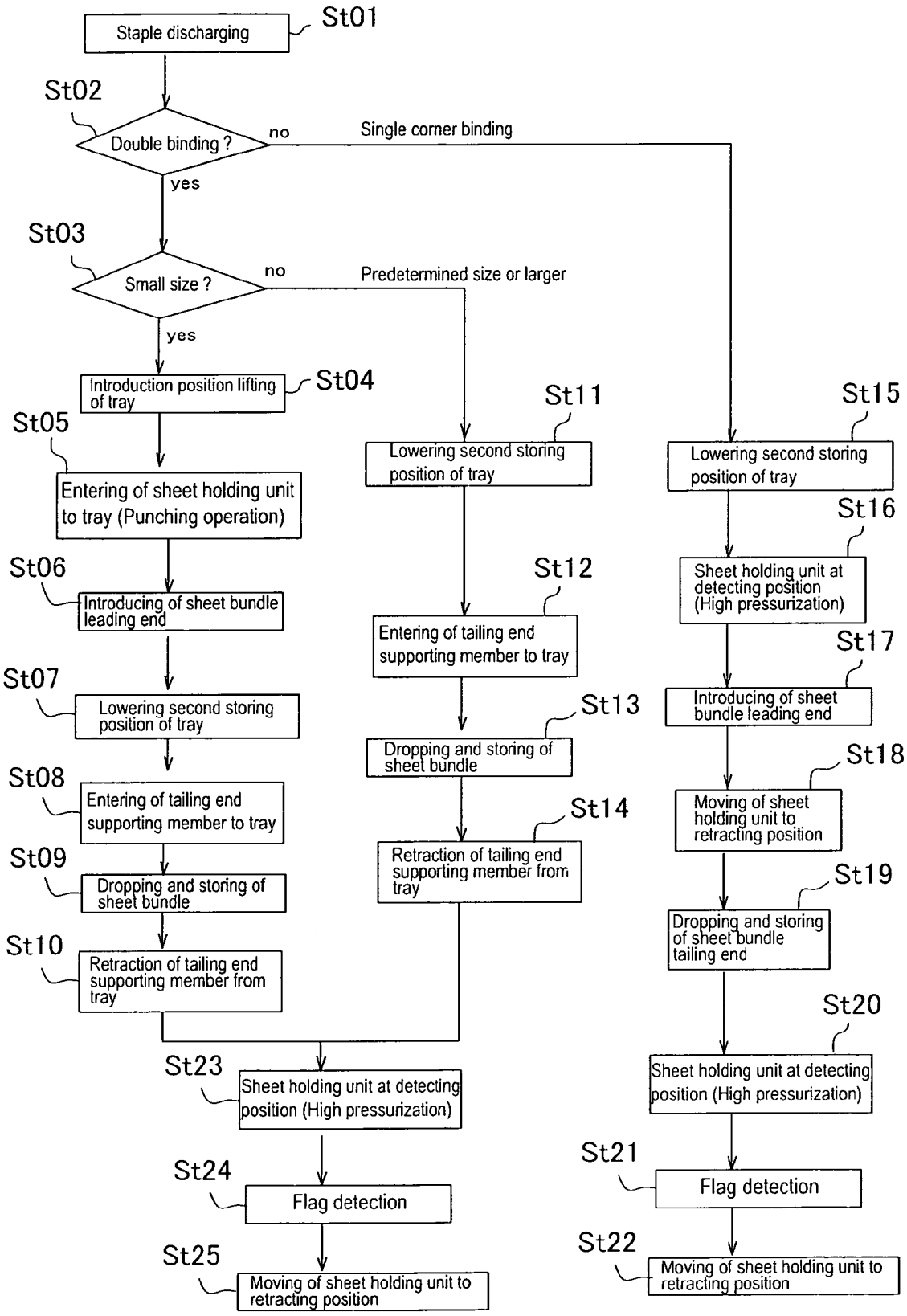
FIG. 22 is an explanatory view of operation flow of a staple discharge mode in which sheets fed from the sheet discharging path are collated and stacked and staple binding is performed thereon in a sheet discharge mode to store the sheets on the stack tray as sheet bundles.

Next, an operation when the second sheet discharge mode is selected in the post-process mode selection step of the image forming apparatus A will be described with reference to FIG. 22. When staple binding is selected as the post-process mode at the image forming apparatus A (St01), the illustrated apparatus is configured to select either double center binding or single corner binding (St02).

[Double Center Binding]

The staple unit 17 described above (hereinafter, also called post-processing means) is mounted on the apparatus frame F so as to be movable in the sheet width direction at the end edge of the processing tray 15 (hereinafter, also called tray means). A staple shift motor (not illustrated) is connected to the staple unit 17. A first binding operation and a second binding operation are sequentially performed as equally distanced from the sheet center as moving the single staple unit 17. In the following, the above operation is simply called a binding operation.

When a job end signal is received from the image forming apparatus A, the control means 85 transmits a binding process command to the staple unit 17 after biasing and aligning a sheet bundle on the processing tray 15. Upon receiving this signal, the staple unit 17 performs the binding process on the sheet bundle on the processing tray 15.

Next, when a process end signal is received from the staple unit 17, the control means 85 discharges the sheet bundle on the processing tray 15 toward the stack tray 40 at the downstream side. Before performing this operation, the control means 85 compares a length (size) of the sheet bundle in the sheet discharging direction (St03). This is for determining to set the height position of the sheet placement tray 42 whether at the second storing height position H2 or at a position higher than the second storing height position H2 (the first storing height position H1 in the illustrated apparatus).

That is, in the illustrated apparatus, in a case with a sheet bundle having a predetermined length or longer in the sheet discharging direction of the sheet bundle, the sheet discharging operation from start to end is performed while the tray height is set at the second storing height position H2. In a case with a sheet bundle having a length shorter than the predetermined length, the tray height is set to the first storing height position H1 at the beginning of sheet discharging and is set to the second storing height position H2 at the ending of the sheet discharging. This is to prevent a short sheet bundle from being stored upside down when the sheet bundle is to be stored as dropping onto the tray with large height difference.

[Case of being Shorter than Predetermined Size]

When the sheet bundle having a binding process performed thereon at the processing tray 15 has a length in the sheet discharging direction shorter than the predetermined size, the control means 85 sets the tray height to be set to the second storing height position H2 in two steps in accordance with sheet discharging, that is, the tray height is set to the second storing height position H2 after being set to the first storing height position H1. Upon receiving the process end signal from the staple unit 17, the control means 85 performs positioning of the sheet placement tray 42 at the first storing height position H1 (St04).

Next, right after lifting the tray position to the first storing height position H1, the control means 85 causes the sheet holding unit 56 to perform swing motion in a predetermined angle from the waiting position to the detection position above the sheet placement tray 42 (St05, punching operation). According to the above operation of moving the sheet holding unit 56 from the state of FIG. 13A to the state of FIG. 13B, that is, from the waiting position to the detecting position, sheet tailing end portion is pushed out toward the sheet placement tray 42 from the tailing end regulating face 48*f* by punching the end edge of the sheet stacked on the sheet placement tray 42 with the sheet holding unit 56 (frictional rotor 60). Accordingly, the sheet end edge is prevented from being caught on the tailing end regulating face 48*f* during the operation of lifting the sheet placement tray 42.

Here, the punching operation described above is not necessarily performed on sheets of all sizes with which the sheet placement tray 42 is lowered in steps. The punching operation is required to be performed on sheets having a relatively-ultrasmall size being a predetermined size such as a strip-shaped size.

As described above, when the length of the sheet bundle in the conveying direction to be conveyed from the processing tray 15 to the stack tray 40 is smaller than the predetermined size, the control means 85 lowers the height position of the sheet placement tray 42 in two steps in accordance with sheet discharging timing, that is, the tray height is lowered to the second storing position H2 after being lowered to the first storing position H1 (St06, St07).

Then, after the height of the sheet placement tray 42 is set to the second storing height position H2, the control means 85 causes the tailing end supporting member 66 to proceed to the side above the sheet placement tray 42 from the waiting position (St08). Next, when the sheet bundle drops on the tailing end supporting member 66, the tailing end supporting member 66 shifts from the first angle posture to the second angle posture (St09). Next, the control means 85 moves the tailing end supporting member 66 to retract from the operating position at the upper side of the sheet placement tray 42 to the waiting position at the outside thereof (St10). Accordingly, the sheet bundle dropped through the discharging port 13 is stored on the upmost sheet on the sheet placement tray 42.

Next, the control means 85 moves the sheet holding unit 56 from the waiting position onto the upmost sheet on the sheet placement tray 42. The pressurization force at that time is set to the high pressurization force, so that the frictional rotor 60 of the sheet holding unit 56 is pressure-contacted to the sheet bundle with the high pressurization force (St23). Then, the control means 85 detects the height position of the sheet holding unit 56 with the first to third flags fr1, fr2, and fr3 and the first to third sensors Lse1, Lse2, and Lse3 (St24). After detecting the height position, the control means 85 moves the sheet holding unit 56 to the waiting position (St25), and along with the above, the control means 85 lowers the sheet placement tray 42 by a predetermined amount.

[Case of being Predetermined Size or Longer]

When the sheet bundle having a binding process performed thereon at the processing tray 15 has a length in the sheet discharging direction being the predetermined side or longer, the control means 85 sets the height of the sheet placement tray 42 at the second storing height position H2 (St11). After the setting of the tray height, the control means 85 causes the tailing end supporting member 66 to proceed to the side above the sheet placement tray 42 from the waiting position (St12). Next, when the sheet bundle drops on the tailing end supporting member 66, the tailing end supporting member 66 shifts from the first angle posture to the second angle posture (St13). Next, the control means 85 moves the tailing end supporting member 66 to retract from the operating position at the upper side of the sheet placement tray 42 to the waiting position at the outside thereof (St14). Accordingly, the sheet bundle dropped through the discharging port 13 is stored on the upmost sheet on the sheet placement tray 42.

Next, the control means 85 moves the sheet holding unit 56 from the waiting position onto the upmost sheet on the sheet placement tray 42. The pressurization force at that time is set at the high pressurization force, so that the frictional rotor 60 of the sheet holding unit 56 is pressure-contacted to the sheet bundle with the high pressurization force (St23). Then, the control means 85 detects the height position of the sheet holding unit 56 with the first to third flags fr1, fr2, and fr3 and the first to third sensors Lse1, Lse2, and Lse3 (St24). After detecting the height position, the control means 85 moves the sheet holding unit 56 to the waiting position (St25), and along with the above, the control means 85 lowered the sheet placement tray 42 by a predetermined amount.

[Single Corner Binding]

When the second sheet discharge mode and the single corner binding operation are specified with a mode setting signal from the image forming apparatus A, the control means 85 performs following operations.

When a job end signal is received from the image forming apparatus A, the control means 85 causes the staple unit 17 to move to the binding position (sheet corner) and to perform a binding operation after biasing and aligning a sheet bundle on the processing tray 15. When a process end signal is received from the staple unit 17, the control means 85 discharges the sheet bundle on the processing tray 15 toward the stack tray 40 at the downstream side.

Before performing the sheet bundle discharging operation, the control means 85 moves the sheet placement tray 42 to the second storing height position H2 (St15). The control means 85 moves the sheet holding unit 56 from the waiting position onto the upmost sheet on the sheet placement tray 42 (detecting position). The pressurization force at that time is set to the high pressurization force and a rotational force is not applied to the frictional rotor 60 (St16).

Next, the control means 85 causes the reversing roller 20 to rotate in the sheet discharging direction, so that the sheet bundle is discharged as being slid on the upmost sheet on the sheet placement tray 42 from the leading end thereof (St17). Here, since the stacked sheet layers (stored sheet bundles) are pressed by the sheet holding unit 56, stacked sheets are not to be moved with a conveyance force of the sheet introduced through the discharging port 13. In particular, when a sheet bundle is pushed out from the processing tray 15 with a strong frictional engagement force onto a corner-bound sheet bundle on the sheet placement tray 42, there is a case that a tear occurs at a portion around a staple needle end. However, since the upmost sheet bundle is supported as being pressed by the sheet holding unit 56 (St20), such a problem will not occur.

Next, the control means 85 detects the height position of the sheet holding unit 56 with the first to third flags fr1, fr2, and fr3 and the first to third sensors Lse1, Lse2, and Lse3 (St21). After detecting the height position, the control means 85 moves the sheet holding unit 56 to the waiting position (St22), and along with the above, the control means 85 lowers the sheet placement tray 42 by a predetermined amount.

Incidentally, the present application claims priority from Japanese Patent Application No. 2012-191419, the contents of which is incorporated herein by reference.

What is claimed is:

1. A sheet storing apparatus, comprising:

a sheet discharging path on which a sheet is discharged through a sheet discharging port;

a processing tray which is arranged downstream of the sheet discharging port and on which a sheet is stored with a conveying direction reversed from the sheet discharging port;

a stack tray which is arranged downstream of the processing tray;

a pair of sheet discharging rollers which is arranged at the sheet discharging port and which conveys a sheet fed from the sheet discharging path selectively to the processing tray or the stack tray;

a roller lifting-lowering device which shifts the pair of sheet discharging rollers between an operation state of being mutually pressure-contacted and a waiting state of being separated; and a control device which controls driving rotation of the pair of sheet discharging rollers and the roller lifting-lowering device, wherein the pair of discharging rollers includes an upper roller which is engaged with an upper face of a sheet fed through the sheet discharging path and a lower roller which is engaged with a lower face of the sheet, the upper roller is formed with a soft roll face having a large outer circumferential diameter and a hard roll face having a small outer circumferential diameter, the roller lifting-lowering device is configured to be capable of adjusting a pressurization force to provide a low pressurization state in which only the soft roll face is contacted to the lower roller and a high pressurization state in which both of the soft roll face and the hard roll face are contacted to the lower roller, and the control device causes a conveyance force to be applied to the sheet fed through the sheet discharging port between the lower roller and the soft roll face or between the lower roller and both the soft roll face and the hard roll face in a selectable manner, wherein the control device provides the high pressurization state in which the hard roll face is engaged with a face of the lower roller when a first sheet is discharged onto the processing tray and provides the low pressurization state in which only the soft roll face is engaged with the face of the lower roller when a second or later sheet is discharged onto the processing tray.

2. The sheet storing apparatus according to claim 1, wherein the lower roller is arranged at a sheet placement face of the processing tray, the upper roller is arranged at an arm member which is swingably supported by an apparatus frame, and the arm member is equipped with the roller lifting-lowering device which lifts and lowers the upper roller to become the operation state to be engaged with the lower roller and the waiting state to be separated from the lower roller.

3. The sheet storing apparatus according to claim 1, wherein the control device sets the pressurization force to be in the high pressurization state in which the hard roll face is contacted to the face of the lower roller when the first sheet is discharged through the sheet discharging port to the stack tray and sets the pressurization force to be in the low pressurization state in which only the soft roll face is contacted to the face of the lower roller when the second or later sheet is discharged through the sheet discharging port to the processing tray.

4. The sheet storing apparatus according to claim 1, wherein a leading end regulating stopper which aligns sheet leading ends and a staple-binding device are arranged at the processing tray, and the control device provides the high pressurization state in which the hard roll face is engaged with the face of the lower roller when a staple-bound sheet bundle is discharged by the pair of sheet discharging rollers from the processing tray to the stack tray.

5. The sheet storing apparatus according to claim 1, wherein the hard roll face has a face hardened through at least one of teflon coating, ceramic coating, and fluorine coating on a face of a resin roll.

6. A post-processing apparatus to perform a binding process as collating and stacking sheets into a bundle shape, comprising the sheet storing apparatus according to claim 1.

7. An image forming system, comprising:

an image forming apparatus which forms an image on a sheet, and the sheet storing apparatus according to claim 1 which stores the sheet fed from the image forming apparatus.

8. A sheet storing apparatus, comprising:

a sheet discharging path on which a sheet is discharged through a sheet discharging port;

a processing tray which is arranged downstream of the sheet discharging port and on which a sheet is stored with a conveying direction reversed from the sheet discharging port;

a stack tray which is arranged downstream of the processing tray;

a pair of sheet discharging rollers which is arranged at the sheet discharging port and which conveys a sheet fed from the sheet discharging path selectively to the processing tray or the stack tray;

a roller lifting-lowering device which shifts the pair of sheet discharging rollers between an operation state of being mutually pressure-contacted and a waiting state of being separated; and a control device which controls driving rotation of the pair of sheet discharging rollers and the roller lifting-lowering device, wherein the pair of discharging rollers includes an upper roller which is engaged with an upper face of a sheet fed through the sheet discharging path and a lower roller which is engaged with a lower face of the sheet, the upper roller is Rained with a soft roll face having a large outer circumferential diameter and a hard roll face having a small outer circumferential diameter, the roller lifting-lowering device is configured to be capable of adjusting a pressurization force to provide a low pressurization state in which only the soft roll face is contacted to the lower roller and a high pressurization state in which both of the soft roll face and the hard roll face are contacted to the lower roller, and the control device causes a conveyance force to be applied to the sheet fed through the sheet discharging port between the lower roller and the soft roll face or between the lower roller and both the soft roll face and the hard roll face in a selectable manner, wherein the control device sets the pressurization force to be in the high pressurization state in which the hard roll face is contacted to a face of the lower roller when a first sheet is discharged through the sheet discharging port to the stack tray and sets the pressurization force to be in the low pressurization state in which only the soft roll face is contacted to the face of the lower roller when a second or later sheet is discharged through the sheet discharging port to the processing tray, and wherein an arm member swingably supports the upper roller so that a pressure-contact point between the soft roll face and the face of the lower roller in the low pressurization state is located at a position being downstream of the pressure-contact point in the high pressurization state in a sheet discharging direction when the upper roller is pressure-contacted to the lower roller.

* * * * *